US006883255B2

(12) United States Patent
Morrow et al.

(10) Patent No.: US 6,883,255 B2
(45) Date of Patent: Apr. 26, 2005

(54) FORWARD LEAN SYSTEM FOR A SNOWBOARD BOOT

(76) Inventors: Neil E. Morrow, 3751 Owyhee Ct. S., Salem, OR (US) 97302; Robert J. Morrow, P.O. Box 4128, Salem, OR (US) 97302

( * ) Notice: Subject to any disclaimer, the term of this patent is extended or adjusted under 35 U.S.C. 154(b) by 239 days.

(21) Appl. No.: 09/761,340

(22) Filed: Jan. 16, 2001

(65) Prior Publication Data

US 2001/0002518 A1 Jun. 7, 2001

Related U.S. Application Data

(62) Division of application No. 08/998,863, filed on Dec. 29, 1997, now Pat. No. 6,189,913
(60) Provisional application No. 60/068,089, filed on Dec. 18, 1997.

(51) Int. Cl.[7] ..... A43B 5/04
(52) U.S. Cl. ..... 36/118.1; 36/117.9; 36/117.4
(58) Field of Search ..... 36/117.4, 117.6, 36/117.7, 117.8, 117.9, 118.1

(56) References Cited

U.S. PATENT DOCUMENTS

| | | | |
|---|---|---|---|
| 240,970 A | | 5/1881 | Cornelius |
| 324,564 A | | 8/1885 | Lamont |
| 327,819 A | | 10/1885 | Osborn |
| 327,966 A | | 10/1885 | Rowlett |
| 1,312,739 A | | 8/1919 | LeBlanc |
| 1,546,551 A | | 7/1925 | Petri |
| 2,693,967 A | | 11/1954 | Jones, Jr. |
| 3,061,325 A | | 10/1962 | Glass |
| 3,636,642 A | | 1/1972 | Walther |
| 3,775,866 A | | 12/1973 | Marker |
| 3,849,914 A | * | 11/1974 | Bertele |
| 3,861,067 A | | 1/1975 | Koyama et al. |

(Continued)

FOREIGN PATENT DOCUMENTS

| | | | |
|---|---|---|---|
| DE | 30 04 668 A1 | | 8/1981 |
| DE | 88 07 537.0 | | 9/1988 |
| DE | 3822113 | * | 1/1990 |
| DE | 41 12 299 A1 | | 12/1991 |
| DE | 42 19 036 A1 | | 1/1993 |
| DE | 44 35 960 C1 | | 3/1996 |
| EP | 0 646 334 A1 | | 9/1994 |
| EP | 0 774 217 A2 | | 5/1997 |
| EP | 0 815 905 A2 | | 1/1998 |
| FR | 2 627 097 A1 | | 8/1989 |
| WO | 97/04843 | | 2/1997 |
| WO | 97/28859 | | 8/1997 |

*Primary Examiner*—Ted Kavanaugh
(74) *Attorney, Agent, or Firm*—Christen O'Connor Johnson Kindness PLLC

(57) ABSTRACT

In accordance with the invention, a boot having a forward lean system is provided that includes medial and lateral side cable members on the boot wherein the cable members are attached to a forward portion of the boot at only one general position. The forward lean system also includes a tension adjustment member connected to the cable members for altering the length of the cable member, thereby providing adjustable forward lean.

26 Claims, 16 Drawing Sheets

U.S. PATENT DOCUMENTS 3,900,204 A 8/1975 Weber
3,937,480 A 2/1976 Korger
3,955,825 A 5/1976 Kubelka et al.
4,021,056 A 5/1977 Oakes
4,096,651 A 6/1978 Ancker
4,177,584 A 12/1979 Beyl
4,178,013 A 12/1979 Bataille
4,185,851 A 1/1980 Salomon
4,191,395 A 3/1980 Salomon
4,290,213 A 9/1981 Salomon
4,316,618 A 2/1982 Sampson
4,334,367 A 6/1982 Salomon
4,360,979 A * 11/1982 Spademan ..... 36/118.8
4,361,344 A 11/1982 Hull et al.
4,395,055 A 7/1983 Spademan
4,403,789 A 9/1983 Hickey
4,454,663 A 6/1984 Graillat et al.
4,494,324 A 1/1985 Spademan
4,542,599 A * 9/1985 Annovi
4,653,203 A 3/1987 De Mattheis
4,657,278 A 4/1987 Klubitschko
4,694,592 A * 9/1987 Baggio et al.
4,709,491 A 12/1987 Morell et al.
4,719,710 A * 1/1988 Pozzobon
4,728,115 A 3/1988 Pozzobon et al.
4,728,116 A 3/1988 Hill
4,735,004 A * 4/1988 Dodge ..... 24/68 B
4,768,804 A 9/1988 With
4,795,185 A 1/1989 Hornschemeyer
4,836,572 A 6/1989 Pozzobon
4,846,492 A 7/1989 Bataille
4,883,286 A 11/1989 Hornschemeyer
4,896,895 A 1/1990 Bettosini
4,897,065 A 1/1990 Fertig et al.
4,907,355 A 3/1990 Allen et al.
4,922,633 A * 5/1990 Sartor
4,937,952 A * 7/1990 Olivieri ..... 36/118.9
4,937,955 A 7/1990 Bonaventure
4,942,680 A * 7/1990 Benetti ..... 36/117.9
4,969,278 A * 11/1990 Ottieri ..... 36/117.8
4,969,655 A 11/1990 Katz
4,973,073 A 11/1990 Raines et al.
4,979,760 A 12/1990 Derrah
5,004,262 A 4/1991 Provence et al.
5,007,656 A 4/1991 Girault et al.
5,028,068 A 7/1991 Donovan
5,035,443 A 7/1991 Kincheloe
5,044,654 A 9/1991 Meyer
5,060,403 A * 10/1991 Battistella et al. ..... 36/118.1
5,071,155 A 12/1991 Stepanek et al.
D325,663 S 4/1992 Barret et al.
5,105,565 A 4/1992 Barret
D327,360 S 6/1992 Graham
5,125,173 A 6/1992 Nagano et al.
5,134,792 A * 8/1992 Balbinot et al. ..... 36/118.1
5,143,396 A 9/1992 Shaanan et al.
5,145,202 A 9/1992 Miller
5,177,884 A 1/1993 Rullier
5,188,386 A 2/1993 Schweizer
5,190,310 A 3/1993 Hauglin et al.
5,190,311 A 3/1993 Carpenter et al.
5,261,689 A 11/1993 Carpenter et al.
5,299,823 A 4/1994 Glaser
5,338,053 A 8/1994 Hauglin
5,345,697 A * 9/1994 Quellais ..... 24/712
5,381,612 A * 1/1995 Paris
5,401,041 A 3/1995 Jespersen
5,417,443 A 5/1995 Blattner et al.
5,454,173 A 10/1995 Falguere et al.
5,474,322 A 12/1995 Perkins et al.
5,505,477 A 4/1996 Turner et al.
5,505,478 A 4/1996 Napoliello
5,520,405 A 5/1996 Bourke
5,520,406 A 5/1996 Anderson et al.
5,556,123 A 9/1996 Fournier
5,558,355 A 9/1996 Henry
5,566,474 A 10/1996 Leick et al.
5,577,755 A 11/1996 Metzger et al.
5,577,756 A 11/1996 Caron
5,584,492 A 12/1996 Fardie
5,586,779 A 12/1996 Dawes et al.
5,595,396 A 1/1997 Bourdeau
5,606,808 A 3/1997 Gilliard et al.
5,609,347 A 3/1997 Dressel
5,636,455 A 6/1997 Meiselman
5,640,787 A 6/1997 Spademan
5,647,148 A 7/1997 Meiselman
D382,320 S 8/1997 Sand
5,660,410 A 8/1997 Alden
5,667,237 A 9/1997 Lauer
5,669,630 A 9/1997 Perkins et al.
5,671,941 A 9/1997 Girard
5,675,917 A 10/1997 Falguere et al.
5,679,039 A 10/1997 Robles
5,695,210 A 12/1997 Goss et al.
5,697,631 A 12/1997 Ratzek et al.
5,701,689 A 12/1997 Hansen et al.
5,704,139 A 1/1998 Okajima
5,713,587 A 2/1998 Morrow et al.
5,713,594 A 2/1998 Jenni
5,722,680 A 3/1998 Dodge
5,755,046 A 5/1998 Dodge
5,871,226 A 2/1999 Klubitschko et al.
5,890,730 A 4/1999 Anderson et al.

* cited by examiner

FORWARD LEAN SYSTEM FOR A SNOWBOARD BOOT

CROSS-REFERENCE TO RELATED APPLICATIONS

This application is a divisional of U.S. patent application Ser. No. 08/998,863, filed Dec. 29, 1997 now U.S. Pat. No. 6,189,913, which claims the benefit of U.S. Provisional Patent Application No. 60/068,089, filed Dec. 18, 1997.

FIELD OF THE INVENTION

This invention relates to snowboarding, and more particularly to an improved snowboard boot and an improved snowboard binding system for securing the snowboard rider to the snowboard.

BACKGROUND OF THE INVENTION

The sport of snowboarding is an increasingly popular wintertime activity wherein a snowboarding enthusiast (hereinafter "snowboarder") maneuvers the board down a snow-covered slope while standing thereon. To facilitate snowboard maneuvers, the snowboarder requires intimate association with the board and therefore bindings are used for securing the snowboarder's boots to the board.

Boots for snowboarding are characterized as either soft or hard. Soft boots employ a flexible shell to permit foot/ankle flexing. Hard boots have similar insulating features, but have a hardened outer shell more particularly suited for specific applications such as downhill skiing. The standard downhill ski boot is worn by a skier for obtaining a rigid association between the skier's feet and lower legs and the downhill ski. In snowboarding, on the other hand, the snowboarder usually desires tight coupling to the snowboard for assisting board manipulation, but at the same time desires a greater degree of freedom for foot/ankle flexing. Unlike downhill skiing, wherein the boots attach to left and right skis with the toes pointed along the respective longitudinal axes, the boots for snowboarding are mounted to the snowboard so that the snowboarder stands over the board with the toes pointed primarily perpendicular to the longitudinal axis with the feet spaced apart from one another beyond shoulder width. With such foot placement, the methods used for manipulating the snowboard generally require that the snowboarder be permitted a great degree of freedom for foot/ankle flexing.

At least two different types of bindings are available for securing boots to a snowboard depending upon the type of boot worn, i.e., hard and soft. Known hard boot bindings use a two engagement point system, with separate toe and heel pieces which bolt to the snowboard via a mounting plate. The toe piece has an engagement clamp for seating a specifically molded toe projection of the hard boot while the heel piece has a clamping bracket, an engagement lever, and a release lever. The clamping bracket releasably engages a molded heel protrusion of the hard boot when the boot is inserted into the binding, the heel of the boot depressing the engagement lever. In order to release the boot from the binding, the release lever is actuated for releasing the heel bracket so that the skier or snowboarder may step out of the hard boot binding. Other hard boot bindings may be one piece and may engage the heel of the boot only, for example. Such one or two point bindings do not always provide a highly stable base for engagement with the board, for a two point binding may tend to allow excessive flexing to either side of a line defined between the two points.

The elements of a soft boot binding include an optional cant, a seating frame including toe and ankle straps and a calf support, known as a highback. The cant supports the frame and comprises a rectangular block which has a flat upper surface sloped relative to its flat bottom surface. The seating frame includes a plate, a heel bracket, and a toe strap mounting bracket. The plate has a pattern of holes for passing bolts used in mounting the plate to the snowboard, or alternatively to the optional cant. Another popular binding style uses a mounting plate with a relatively large hole in the center, with a corresponding disk, which engages the mounting plate hole. The disk is bolted to the snowboard and thus secures the mounting plate to the board. The boot is held to the board by interaction with the binding plate.

The toe and ankle straps of the soft boot binding have essentially identical elements and functionality except that the length of the ankle strap is generally longer than that of the toe strap. Each strap cooperates with the seating frame for strapping over respective toe and ankle portions of a boot for securing the boot to the frame. The strap system requires, however, that the snowboarder place the boot in the binding and then manually tighten each of the straps in order to secure the boot to the binding.

The known binding systems, however, are somewhat constraining in that they employ a fixed stance and a fixed flexibility for leaning and side-to-side movements. As a rider becomes more skilled at snowboarding, it is often desired to be able to adjust the action of the binding such that the angle of the rider's leg with respect to the horizontal plane, is adjusted. Further, the rider may often wish to change the stance orientation with respect to the board, the stance width, the rotation of the rider's feet or the relative centering of the boot with respect to the board, such that different maneuvers are possible. For example, the rider may wish a differing amount of freedom for medial leans, i.e., inwardly toward the center of the rider's body, versus lateral leaning, i.e., away from the center of the rider's body. It is also desirable that the medial and lateral lean directions be substantially parallel to the longitudinal axis of the snowboard. Heretofore, such lean direction adjustment or lean tension with respect to the board has been fixed and would require replacement of the binding or adjustment of the highback to a different location along an adjustment slot to enable a different degree of freedom in any particular motion or direction. Similarly, the amount of lean has been somewhat fixed as well as the amount of force applied to pull the board upwardly when the rider leans.

Other binding types also result in a rigid boot, for example as shown by Raines et al, U.S. Pat. No. 4,973,073. Raines et al employ an elongate binding ridge which extends along the central portion of the boot, laterally away from the sole of the boot. The ridge is engaged by a corresponding receiving member on the snowboard. However, the elongate nature of the binding ridge adds stiffness to the boot, making walking with the boot while not attached to the snowboard uncomfortable or unnatural feeling.

Further, heretofore, boot highbacks have been fixed in relation to the boot, so it was not possible for a rider to change the pivot angle of the highback relative to the boot, without completely switching to another boot.

SUMMARY OF THE INVENTION

In accordance with the invention, a boot having a forward lean system is provided that includes medial and lateral side cable members on the boot wherein the cable members are attached to a forward portion of the boot at only one general position. The forward lean system also includes a tension adjustment member connected to the cable members for altering the length of the cable members, thereby providing adjustable forward lean.

It is yet another object of the present invention to provide an improved binding that is easily adaptable for receiving a left or a right foot at a given binding location.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
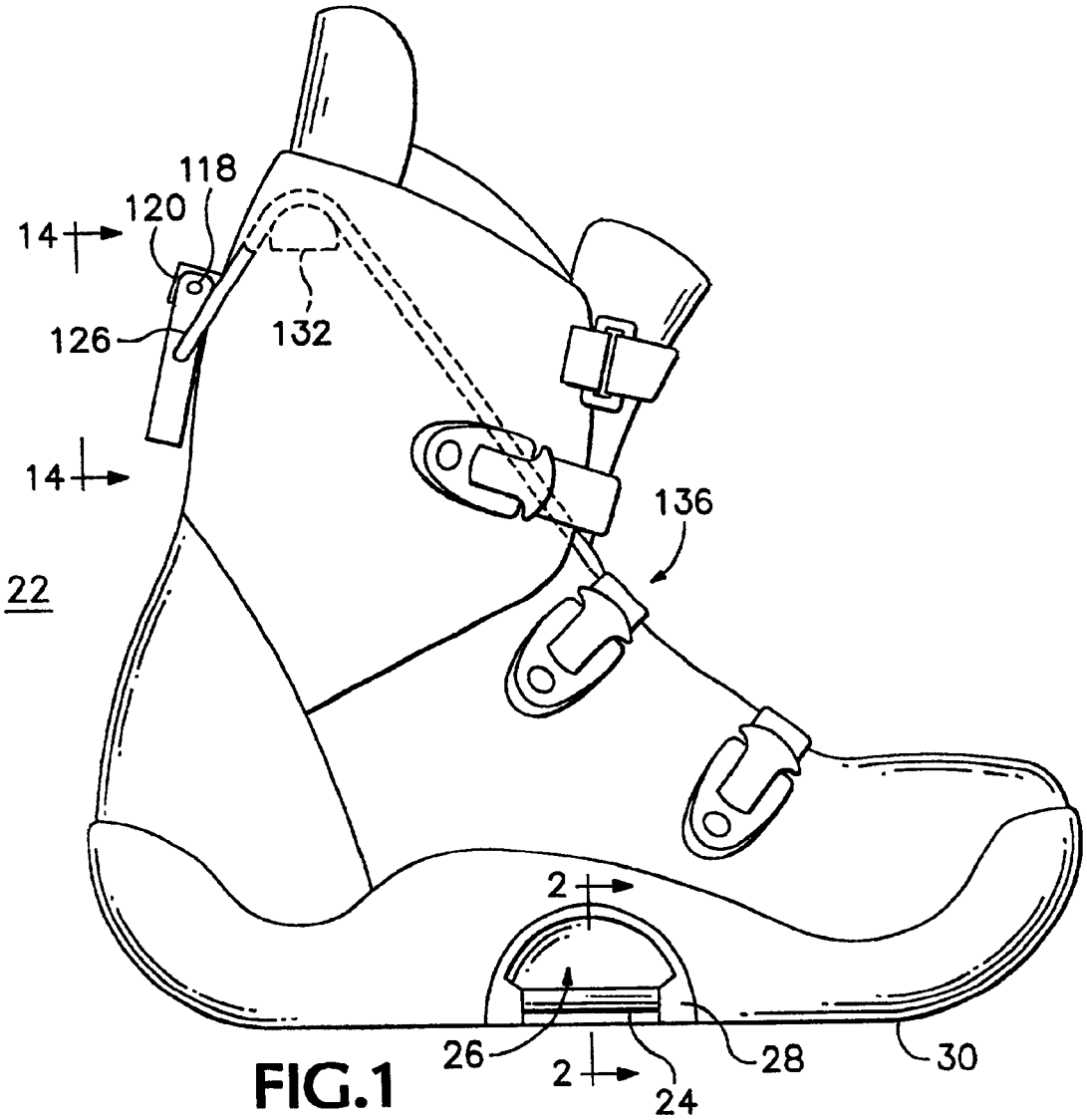
FIG. 1 is a lateral side view of a snowboarding boot according to the present invention.
Figure 2:
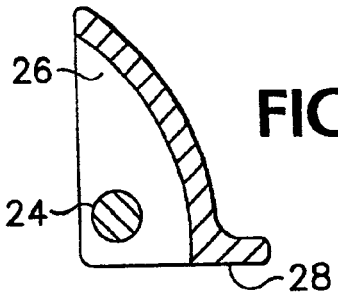
FIG. 2 is a sectional view of the engaging pin region of the boot of FIG. 1, taken along line 2—2.

Referring to FIG. 1, a lateral side view of a snowboard boot in accordance with an embodiment of the invention, the boot 22 includes a lateral binding engaging pin 24, located approximately centrally with respect to the front and rear ends of the boot, slightly forward toward the toes. Pin 24 is oriented substantially parallel to the bottom surface of the boot (which in use positions the pin parallel to the surface of a snowboard) and is set in slightly from the outer edges of the boot, both horizontally and vertically. In a particular embodiment, the exposed length of the pin is approximately one inch. The secured ends of the pin enter into the body of the boot, but the exposed portion is substantially free from engagement by the boot, and is surrounded by a semispherical void 26. FIG. 2, a sectional view of the pin 24 and semispherical void 26 taken along line 2—2 of FIG. 1, illustrates the relative spacing of the pin to the center of the void. Referring to FIG. 1 and FIG. 2 together, the semispherical void is defined into the sole 30 of the boot, and may comprise a material 28 that is substantially more abrasion resistant than the rest of the sole of the boot, which is intended more for traction or grip. The increased abrasion resistance ensures longer wear of this portion 28 of the boot, as it is continuously engaging and disengaging with portions of the binding system as will be discussed hereinbelow.

Figure 3:
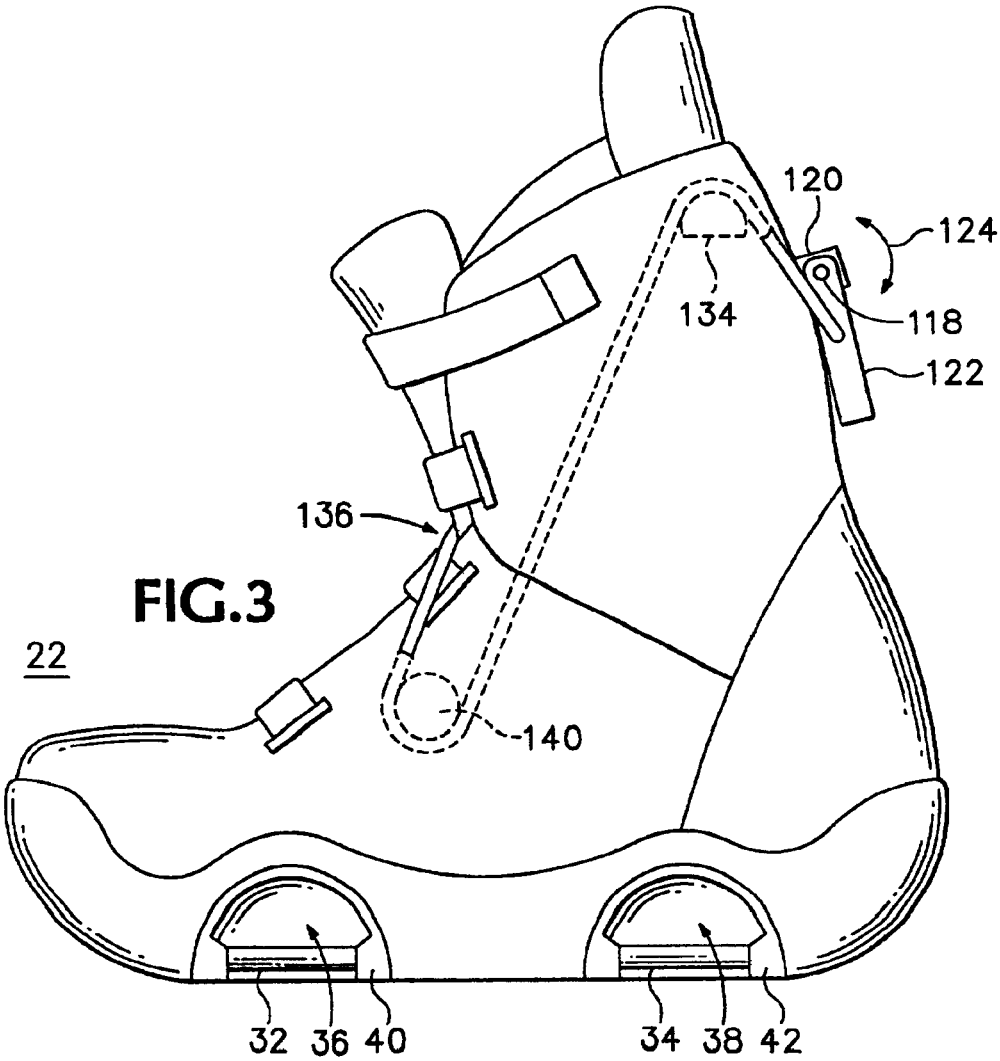
FIG. 3 is a medial side view of the boot of FIG. 1.

Referring to FIG. 3, a view of the medial side of the snowboard boot, the boot has a forward binding engaging pin 32 disposed forwardly of the front-to-rear center line of the boot on the boot's medial side, and a rearward binding engaging pin 34 positioned on the rear side of the front-to-rear center line of the boot, toward the heel region. Pins 32 and 34 are contained within respective concave semispherical regions 36 and 38, where regions 36 and 38 have corresponding cross sectional shapes to the shape of portion 28 of the lateral side (although this is not a requirement), wherein the semispheres are suitably defined within harder shells 40 and 42.

Figure 4:
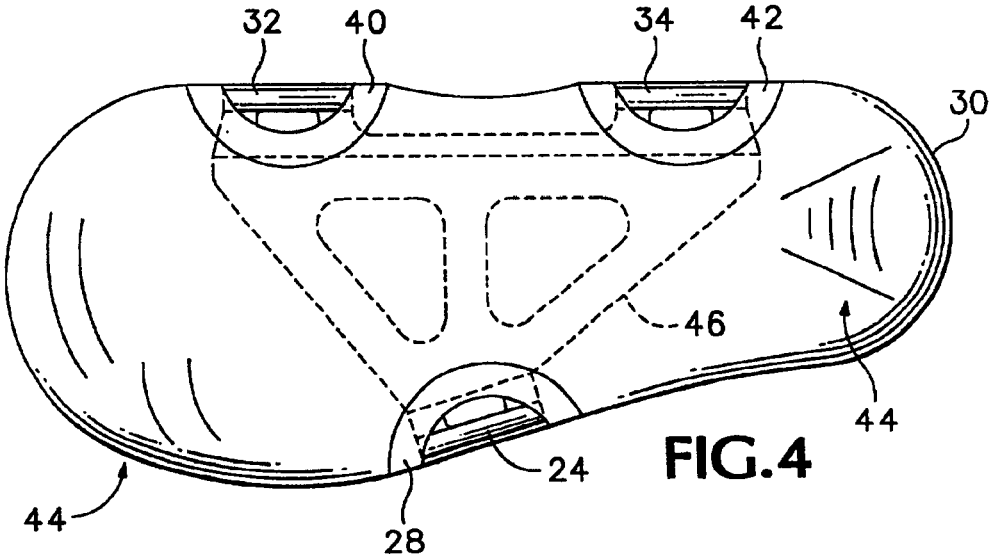
FIG. 4 is a bottom view of the boot of FIG. 1 and FIG. 3 with the interior frame member illustrated in phantom.
Figure 23:
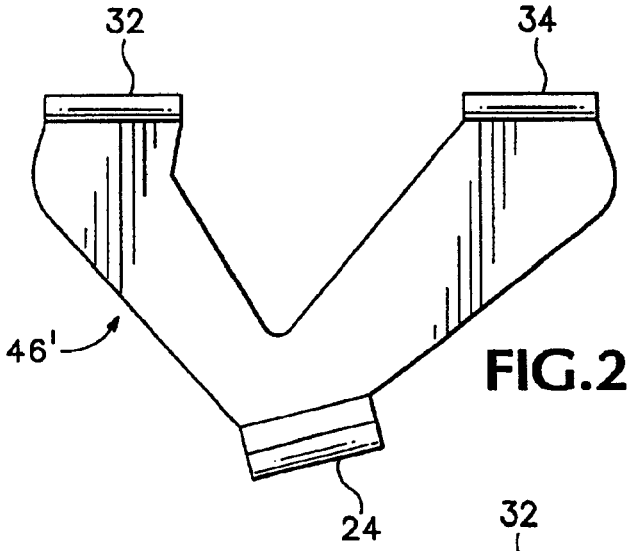
FIG. 23 is an alternative structural frame member having less rigidity or stiffness.
Figure 24:
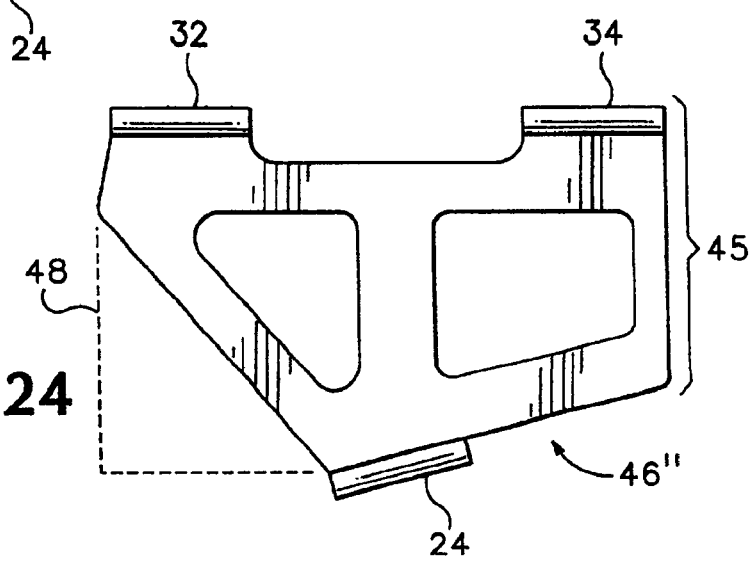
FIG. 24 is another alternative structural frame member having greater rigidity.

FIG. 4 is a bottom view of the boot of FIG. 1 and FIG. 3, further showing construction detail thereof. The bottom of sole 30 may carry a tread pattern 44, thereon, to provide increased traction for walking and for standing on the snowboard. Substantially parallel to the plane of the bottom of the sole and located within the interior of the boot body, is a structural frame member 46, shown in phantom in FIG. 4, wherein the lateral engaging pin 24 and the medial engaging pins 32 and 34 are spatially positioned relative to one another by the structural frame member. The pins 24, 32, 34 may either be connected to the structural member, or may be formed as an integral portion thereof. In a preferred embodiment, the pins and structural frame member are constructed from aluminum. The frame member is suitably formed within a portion of an insole within the boot interior, wherein the insole is made of plastic, for example, and roughly conforms to the shape of a wearer's foot. The relative stiffness of the boot is at least partially determined by the frame member. Therefore, it is possible to construct a boot with a modified frame member, such that the frame member is stiffer or less stiff. Referring to FIG. 23, a less stiff structural frame member 46' is shown. Frame member 46' interconnects pin 24 with pin 32, and pin 24 with pin 34, but, unlike structural frame member 46 of FIG. 4, frame 46' does not directly interconnect pins 32 and 34. Therefore more independent movement or flexing of the pins relative to each other can occur. FIG. 24 illustrates a stiffer frame member 46", wherein the frame defines a more rectangular region. This frame member will be substantially more rigid than the frame of FIG. 22. A further removable tab 48 is illustrated in phantom. This removable tab, if left in place, makes an even more rigid frame. Also, the rigidity can be altered by employing different thicknesses of material in the frame member. For example, with the frame member of FIG. 24, when constructed of metal, may suitably employ a relatively thick region near the heel region 45, to provide greater stiffness. However, the area near region 48 can be relatively thin, to allow more flexing. The riding performance characteristics of the boot and binding are changed depending on the stiffness characteristics of the frame, so boots with different responses can be provided to suit a snowboarder's particular riding style or tastes, by using a boot with a different frame member therein.

Figure 31:
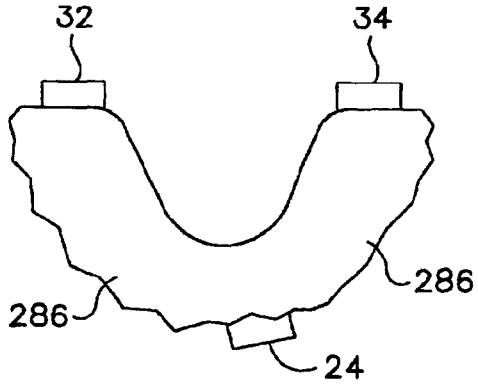
FIG. 31 is yet another alternative structural frame member having less rigidity or stiffness.

For a boot having different characteristics, a further embodiment of the frame 46 is illustrated in FIG. 31, wherein each of the medial binding pins 32 and 34 are connected to lateral binding pin 24 via members 286 which are relatively flexible as compared with metal. Such a binding frame will result in a boot that is able to flex much more than those boots employing a rigid frame. Members 286 may comprise, for example, glass filled plastic or nylon members.

Yet another alternative frame extends all the way to the heel region of the boot and up around the sides of the foot. A still further embodiment employs a beam member connecting 2 of the pins (e.g. pins 32, 34) and a second beam member connecting the third pin to the first beam member.

Figure 5:
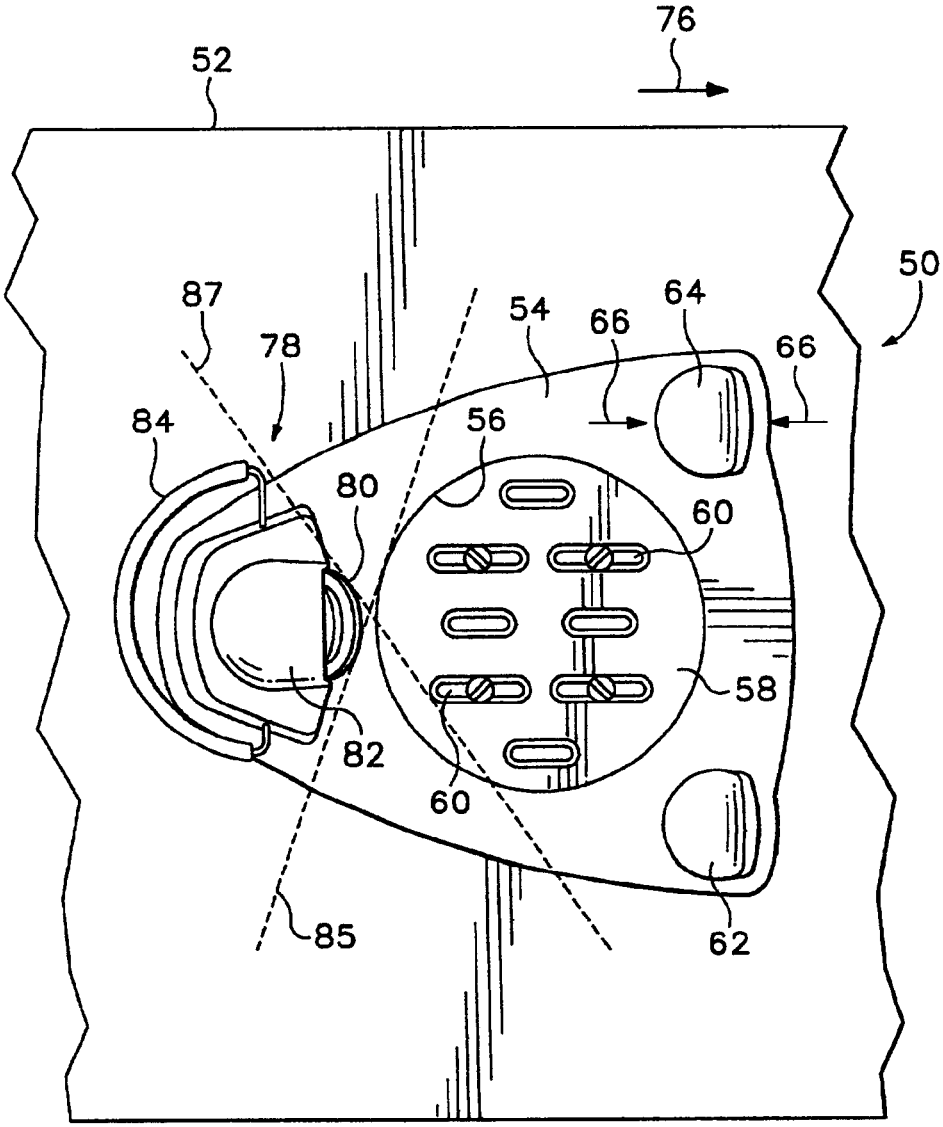
FIG. 5 is a top view of a binding apparatus in accordance with an embodiment of the invention, with a portion of a snowboard also shown.

In order to use the boot, a corresponding binding member is employed on a snowboard, to secure the boot to the board during riding. Referring to FIG. 5, a top view of a binding apparatus in accordance with the invention, with a portion of a snowboard also shown, together with FIG. 6, an end view of the binding and snowboard of FIG. 5, the binding system 50 is attached to the surface of a snowboard 52 via any suitable means. In the illustrated embodiment, a relatively planar binding base member 54 includes a central circular opening 56 therein, which may suitably have a series of teeth or serrations about the inner circumference thereof. A binding disk 58 is circular and of a diameter to fit within the opening 56. A series of mating teeth or serrations are provided on the underside of the disk to mesh with the corresponding teeth in the base member. Disk 58 preferably is of slightly larger diameter than the opening in the base member, so that its perimeter overhangs the upper surface of the base plate, or a shallow perimeter trough is defined in the base member to correspond to the overhang of the disk. A series of slots 60 are provided in the disk for receiving fasteners therein. The fasteners mate with corresponding members defined in the surface of the snowboard, whereupon tightening of the fasteners as positioned in the slots 60 will pull the disk down towards the surface of the snowboard, thereby pulling the binding base member into tight engagement with the snowboard surface.

Secured to the base member at the medial edge thereof are front and rear medial binding pin engaging dogs 62 and 64, spaced apart from each other a distance corresponding to the distance between front and rear boot medial binding pins 32 and 34. Dogs 62 and 64 have a mushroom like shape, with a narrower base region 68 and an overhanging upper region 70, at least as considered in the area toward the lateral side of the binding. The top surface of the upper region 70 is substantially convex-spherical in shape. The overhang defines an upward stop 72, which provides a flat surface region that is horizontally oriented and substantially parallel to the surface of the snowboard and that is advantageous for engaging and preventing movement of boot binding pins 32 and 34 as will be described hereinbelow. A vertically aligned medial stop 74 is provided by the inner vertical wall of the dogs, preventing movement beyond a stop position in the medial direction 76. Dogs 62 and 64 are suitably fixed to the binding plate 54 and do not move relative thereto.

Figure 6:
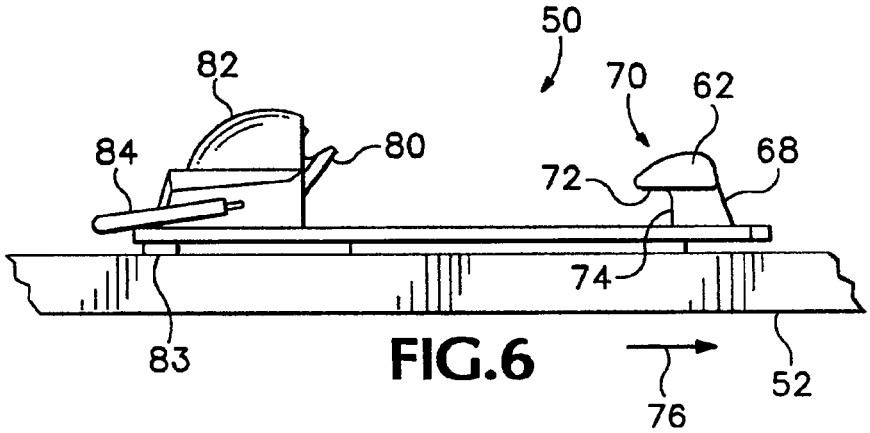
FIG. 6 is an end view of the binding and snowboard of FIG. 5.

At the lateral edge of the binding base plate is the binding latch mechanism 78. The basic pieces of the mechanism 78 are the lateral binding pin receiver 80, which comprises a semicircular disk with a binding pin receiving channel about the perimeter thereof, a hollow housing member 82 which contains the operative components of the latch mechanism therewithin, and a binding latch release control 84. In FIG. 5 and FIG. 6, the binding pin receiver 80 is in the open position, ready to receive the boot lateral binding pin 24 therein. Underneath the binding plate 54, an elastomeric spacer 83 may be provided to ensure a tight engagement between the board and the binding, at least at the lateral side thereof.

Figure 7:
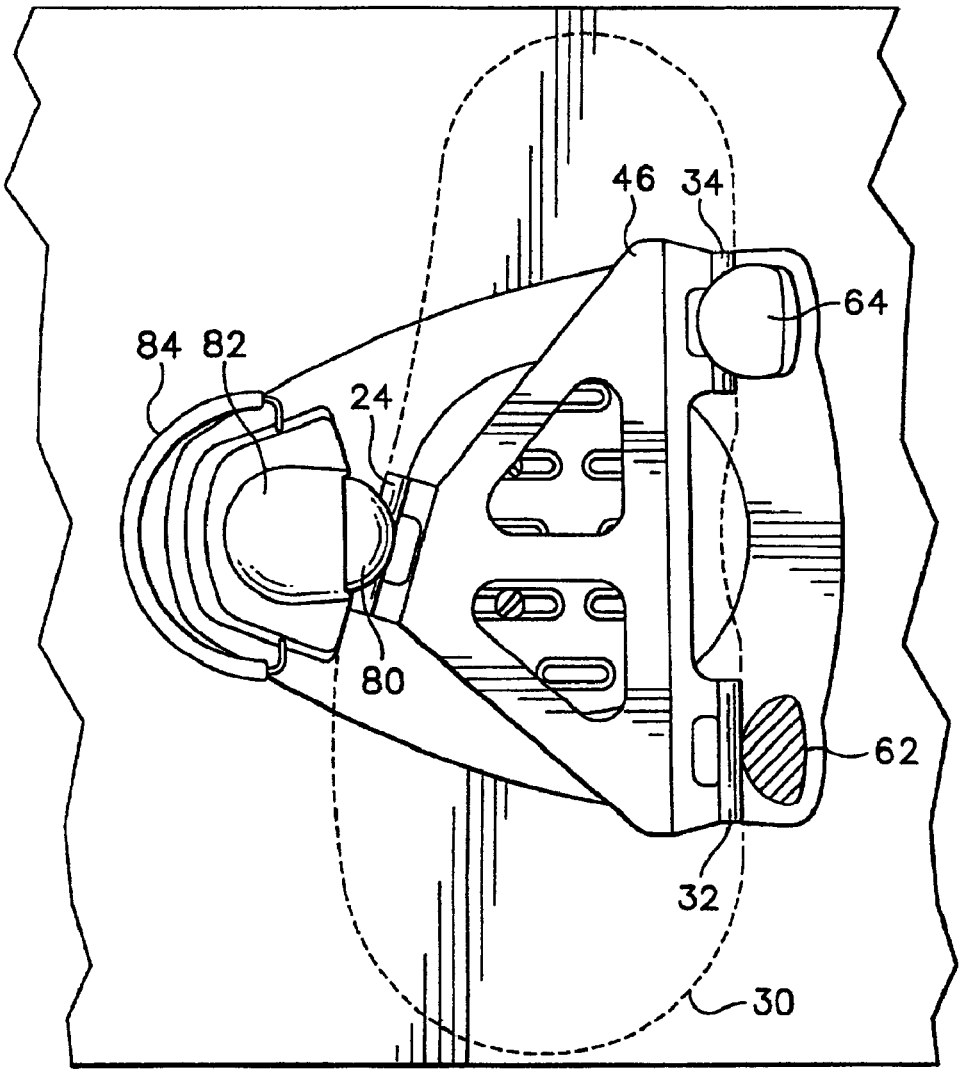
FIG. 7 is a top view of a boot and binding system according to the present invention, with the boot illustrated in phantom to show the interaction with the internal boot frame and the binding apparatus.
Figure 8:
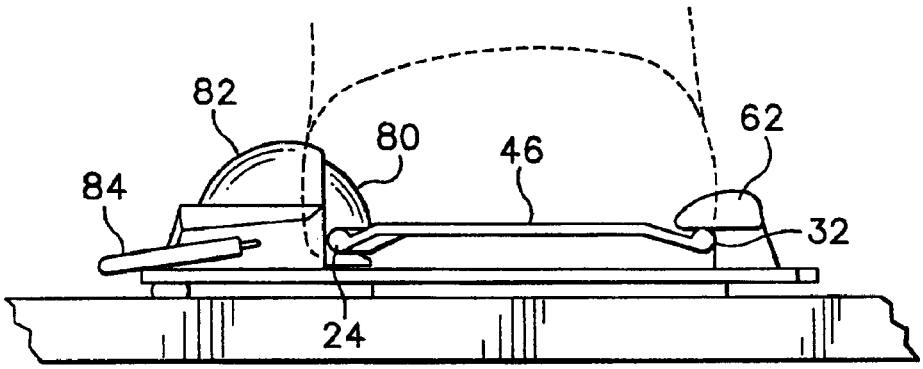
FIG. 8 is an end view from the front of the system of FIG. 7, with the boot again in phantom.

Now, referring to FIG. 7, a top view of a boot and binding system according to the present invention, with a boot engaged therein and illustrated in phantom to show the interaction with the internal boot frame and the binding apparatus, and to FIG. 8, a front end view of the system of FIG. 7, to secure the boot within the binding, a snowboarder first positions the boot above the binding slightly more to the lateral side of the binding and with the medial edge of the boot tilted downwardly relative toward the horizontal. Then, moving the boot in a medial direction, the binding pins 32 and 34 move into engagement with the medial dogs 62 and 64. The binding pins 32 and 34 are thus trapped by dogs 62 and 64 against further medial movement as well as against upward movement. Now, the snowboarder pivots the lateral side of the boot down, which causes lateral binding pin 24 to meet lateral pin receiver 80. As a result of the configuration of the latching mechanism described hereinbelow, the latching mechanism pivots downwardly with the downward movement of the boot, and locks in the position shown in FIG. 8, effectively trapping the lateral binding pin against escaping from the receiving channel in the receiver 80. The cooperation of the binding pins, the dogs and the latch mechanism result in the boot being secured to the binding, and therefore the rider is now secured to the snowboard (at least with respect to this first foot). If the rider's second foot is to be secured to the board, a second binding system and boot are suitably provided. In FIG. 7 and FIG. 8, it may be observed that receiver 80 is convex-spherical in shape along a top portion thereof. This spherical portion is pivotally retracted within housing 82 when the receiver is in the unlatched position of FIG. 5 and FIG. 6.

Still referring to FIG. 7, the structural frame member 46 may be observed with its relationship to the binding pins. Trapping the binding pins thereby anchors the structural frame, and as the frame is secured within the boot, a stable engagement between the rider and board is provided.

Considering FIGS. 1–8 together, the convex semispherical upper portions of dogs 62 and 64 suitably are received within the respective concave semispherical regions 36 and 38 at the boot's medial side, and the convex semispherical portion of receiver 80 mates with the corresponding concave semispherical void 26 of the lateral side of the boot. Therefore, even if the boot is not precisely aligned as it is moved in toward the binding, the shapes of the dogs and voids will assist in guiding the boot and binding together.

Figure 9:
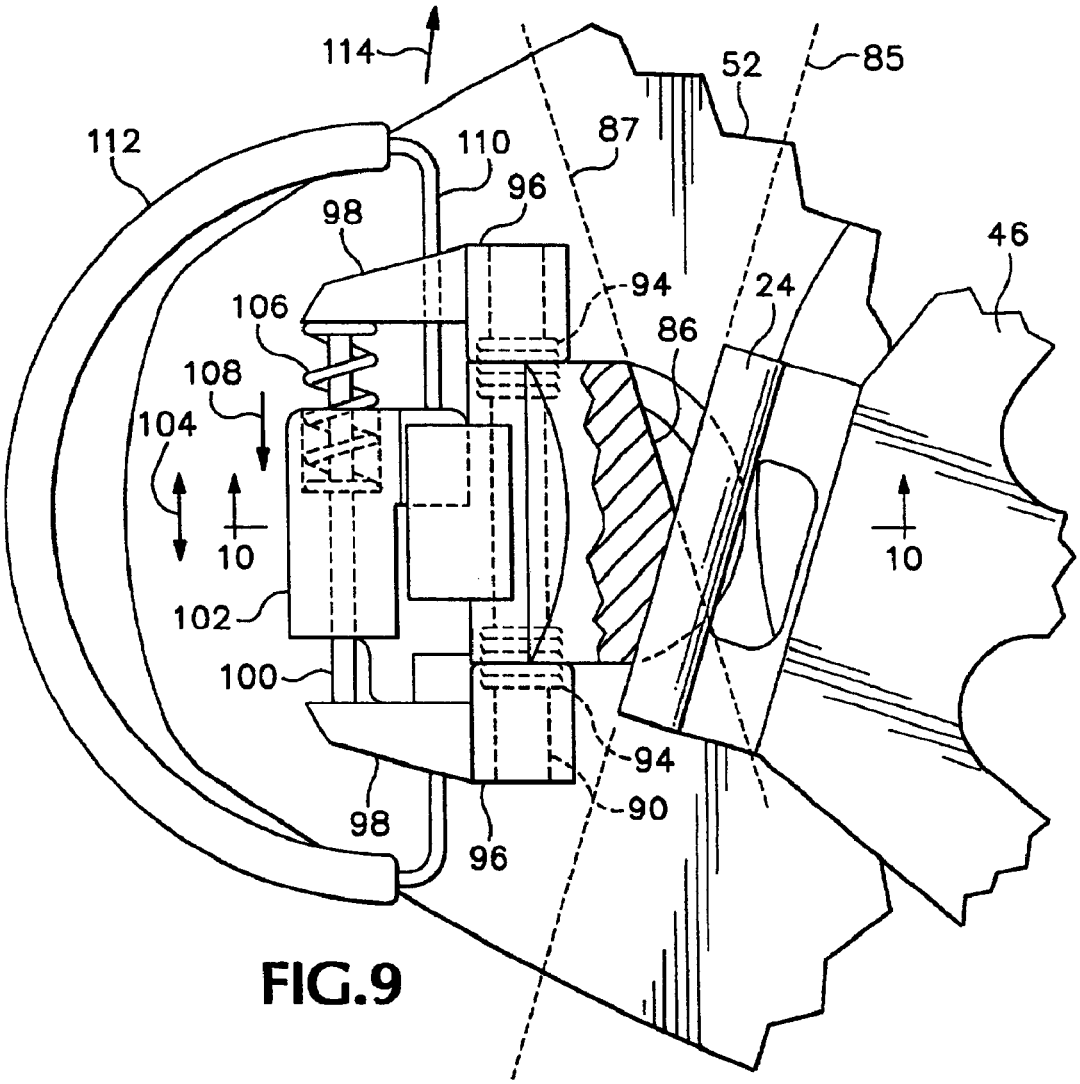
FIG. 9 is a partial sectional illustration of the latching portion of the binding system taken from the top thereof showing in greater detail the interaction of the internal boot frame with the binding.
Figure 10:
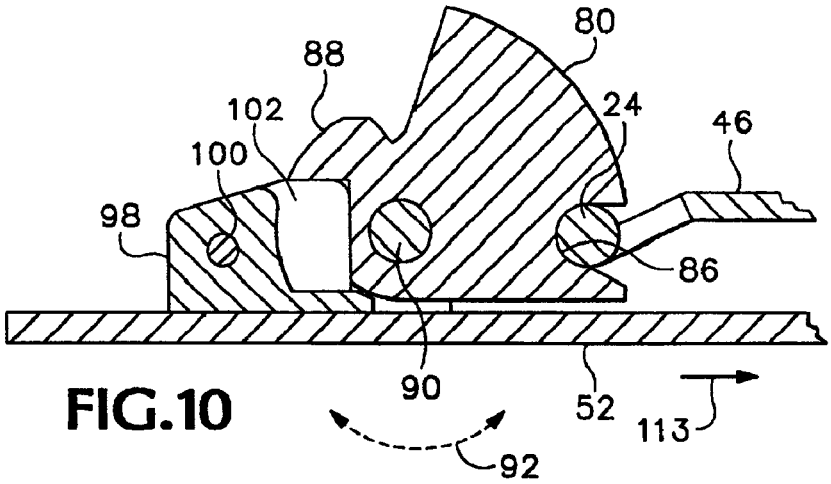
FIG. 10 is a sectional view of the engaged boot and binding, taken along line 10—10 in FIG. 9.

As alluded to hereinabove, once the snowboarder steps into the binding, receiver 80 moves to a latched position. FIG. 9 is a partial sectional illustration of the latching portion of the binding system viewed from the top with housing cover 82 removed, showing in greater detail the interaction of the internal boot frame with the binding. The engaging pin 24, as secured to frame 46 is held in position by receiver 80, in a slot 86 which has a first portion aligned along axis 87 and a second portion aligned along axis 85. Referring also to FIG. 10, a sectional view of the engaged boot and binding, taken along line 10—10 in FIG. 9, receiver 80 includes an arm portion 88 defining a shelf, at the side of the receiver distal from the slot 86. Receiver 80 is pivotally mounted on a shaft 90 to allow rotation along the arc 92 shown in FIG. 10. A pair of springs 94 are fitted on the shaft 90, and suitably bias receiver 80 into the open or unlatched position (as in FIG. 6, for example). Shaft 90 is supported at its ends by first and second shaft supports 96. The shaft supports include a laterally extending leg portion 98, which supports a shaft 100 in spaced, relation to and parallel with shaft 90. The leg portions define a space between each other. In the illustrated embodiment, shaft 100 is of lesser diameter than shaft 90. A catch member 102 is slidingly mounted to shaft 100, and is suitably translatable along the direction of arrow 104, to slide back and forth between the two legs 98. Catch member 102 defines an inverted L shape. A biasing member 106, suitably a spring, is positioned around the shaft 100, and is partially received within a bore at the base end of the inverted L shaped catch member. The opposing end of the biasing member pushes against one of the legs 98, suitably urging the catch member 102 in the direction of arrow 108, away from the one leg member 98. It will be noted that as a result of the positioning of the catch member 102 and arm portion 88 of receiver 80, the biasing member causes the L leg of the catch member to slide underneath the flat shelf portion of arm 88. Accordingly, receiver 80 is prevented from rotating to the open position about shaft 90, since the catch member acts as a block by its position underneath arm 88.

Still referring to FIG. 9, a release cable 10 passes through an opening in one of legs 98, and is attached to the distal end of the L portion of catch member 102. Cable 110 then loops around, along the lateral side of the binding, and is connected to the other one of the legs 98. A covering 112 is provided, to increase the diameter of the cable and provide a gripping member for ease of grasping by the snowboarder.

Accordingly, while biasing member 106 urges the catch 102 in the direction of arrow 104, causing the L shaped leg of the catch to be positioned underneath the arm 88 of the receiver member, which keeps the receiver positioned in its closed position, suitably keeping the binding pin 24 trapped within the slot 86. Rotation of the receiver 80 results in the slot or channel 86 rotating to surround the pin 24 above, below and to the lateral side thereof. The pin is thus prevented from moving upwardly, downwardly or laterally. Medial movement in the direction of arrow 113, is prevented because the medial binding pins 32 and 34 are trapped against medial, upward or downward movement by the dogs 62 and 64, and the three binding pins 24, 32 and 34 are all maintained in their spatial configuration relative to one another by the structural frame. The pins, structural frame and therefore the boot, are thereby secured within the binding.

Figure 11:
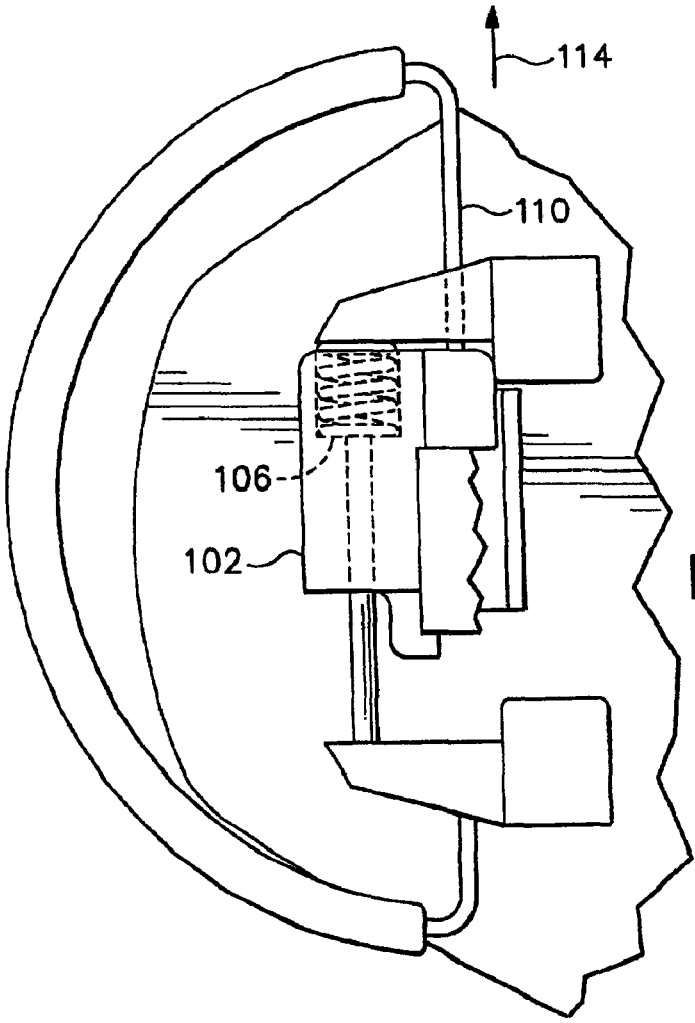
FIG. 11 is a top partial cut away view of the binding of FIG. 9, illustrating the released position.
Figure 12:
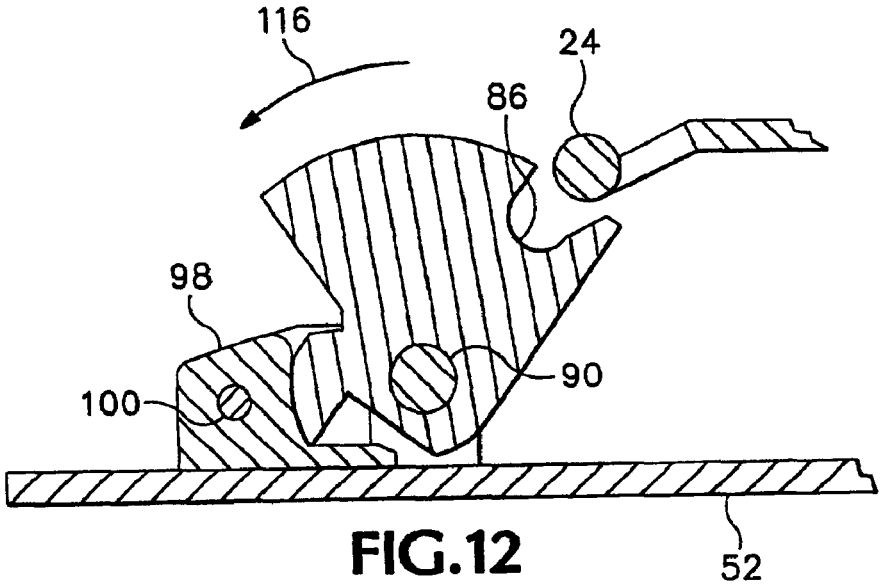
FIG. 12 is a sectional view of the binding system of FIG. 11 taken along line 12—12.

FIG. 11 is a top partial cut away view of the binding of FIG. 9, illustrating the released position thereof, while FIG. 12 is a sectional view of the binding in its state of FIG. 11, taken along line 12—12. In FIG. 11, cable 110 has been pulled in the direction of arrow 114, which pulls catch member 102 in the same direction and compresses the spring biasing member 106. As the catch member is pulled a sufficient distance in the direction of arrow 114, the L leg of the catch member is pulled beyond the edge of arm 88, and as it is no longer underneath the shelf defined by the arm, receiving member 80 is now free to rotate in the direction of arc 116 (FIG. 12). So, the snowboarder can now lift up the lateral edge of the boot, which will cause rotation of the receiver along arc 116 about the shaft 90. The spring biasing members 94 (FIG. 9) will assist in urging the receiver to remain in its upper, open orientation until such time as the snowboarder again inserts the binding pin 24 into slot 86. Then, as the receiver 80 pivots downwardly, arm 88 will eventually move to a position where it no longer blocks catch member 102 from moving, and the bias of spring 106 will then urge the catch member away from the spring, to move it into the blocking position of FIGS. 9 and 10, to secure the binding in the close position. Therefore, in accordance with the invention, a step-in style binding that allows quick, hands-free engagement of the boot and binding is provided, with a three point engagement system. The binding will maintain the boot therein until such time as the snowboarder pulls on the release cable, to free the catch and arm mechanisms.

Referring again to FIG. 5, a further advantage of the binding system in accordance with the present invention is illustrated by dashed lines 85 and 87 (also shown in FIG. 9). Lines 85 and 87 represent the angle of engagement of the binding pin of the boot when the left and right feet are being employed. Assuming the illustrated binding is the forward-most binding on the snowboard, if the rider prefers to have the left foot forward on the board, then the binding base plate 54 might be in the illustrated configuration, and the lateral binding pin 24 of the boot will engage receiver 80 somewhat along the angle of line 85. However, if the rider prefers the other boot to be in this binding, then the disk 58 is loosened, and the base 54 is rotated approximately 14.5 degrees or so, to move the lateral latch portion. Now, the other foot's boot binding pin 24 will mate with receiver 80 approximately along line 87. If a simple straight receiver portion were employed, the angle of the receiving member would now be wrong, and the angle of the receiver would not now match the angle of the binding pin in the boot. With the multi-angled channel 86 of the receiver (first and second angled portions on axes 85 and 87), a wide range of angles of orientation is accommodated, without having to replace the binding with a different orientation binding.

Figure 13:
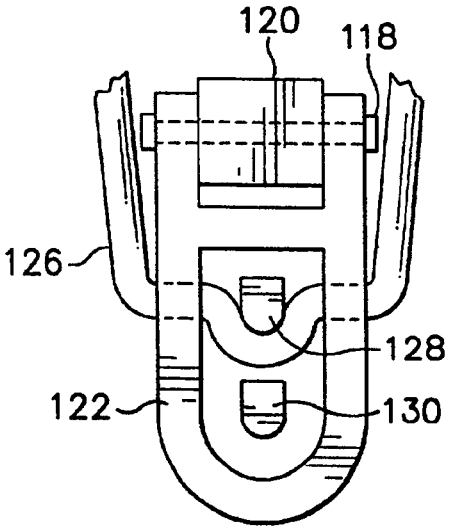
FIG. 13 is a rear view of the boot forward lean adjustment mechanism according to the invention.
Figure 14:
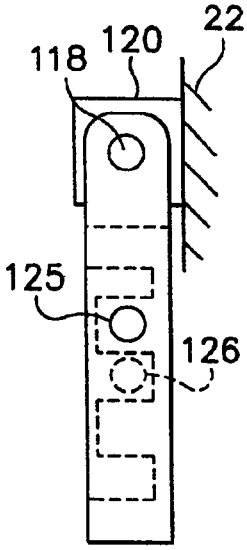
FIG. 14 is a side view of the forward lean system of FIG. 1 at line 14—14 illustrating the position of the cable member.
Figure 15:
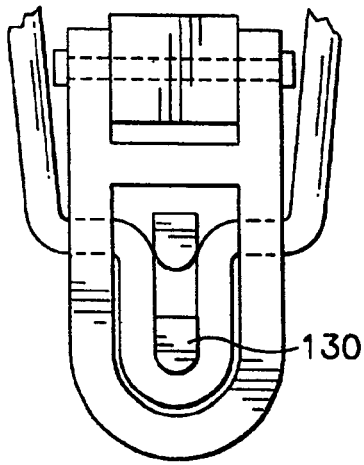
FIG. 15 is a rear view of the boot forward lean adjustment system with the cable in an alternative position.

Referring now to FIGS. 1 and 3, together with FIGS. 13–15, which are a rear view of the boot tensioning adjustment mechanism according to the invention, a side view of the tensioning system of FIG. 13 illustrating the position of the cable member, and a rear view of the boot tensioning system with the cable in an alternative position, respectively, a shaft 118 is secured on an arm 120 at an upper rear portion of the boot 22. Pivotally mounted to the shaft is an engagement member 122, which is able to rotate about the shaft along arc 124 (FIG. 3). A tension cable 126 passes through the engagement member via apertures at either side thereof. The apertures and cable are suitably sized so that the cable may be freely fed and moved through the apertures. The engagement member extends away from the end thereof receiving the shaft, and includes first and second shelf dogs 128 and 130 in spaced relation to each other, dog 128 being positioned closer to shaft 120 than dog 130. The space between the dogs is sufficient to allow the cable 126 to easily be placed therebetween. As can be seen in FIGS. 1 and 3, cable 126 extends around from the back of the boot and the engagement member, up over a medial guide 134 and a lateral guide 132, where the guides are positioned at least partially around the sides of the boot. The guides are suitably hidden from view by the external covering of the boot, and the cable passes through the boot's covering to reach the guide. The cable continues over the guide around the medial side of the boot to an attachment point 136 at the front of the boot, at a position on the top of the boot forward of the ankle region. On the lateral side of the boot, the cable continues down from guide 132 to a second guide 140.

Figure 16:
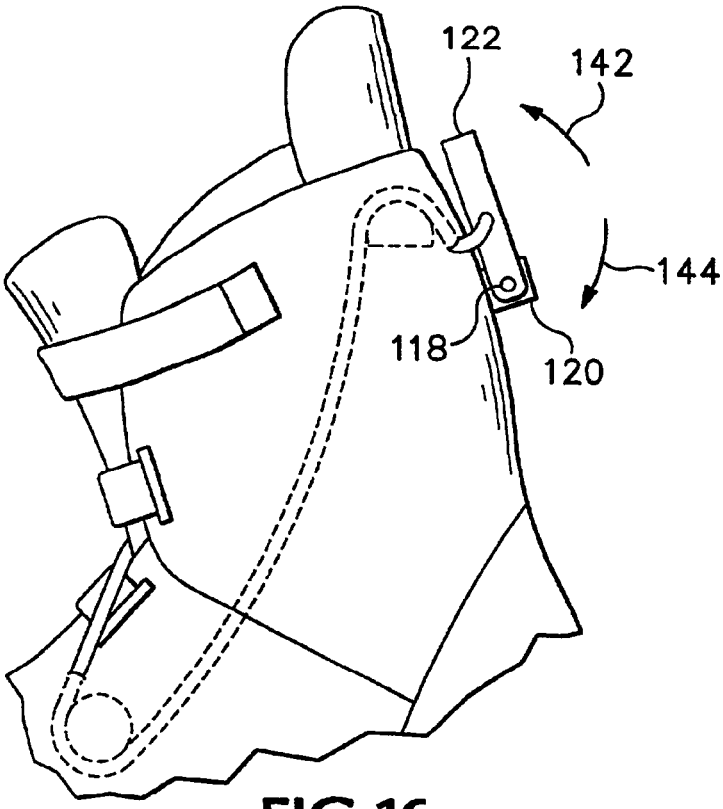
FIG. 16 is a partial side view of the forward lean adjustment system in the released position.

The cooperation of the aforementioned elements enable tension adjustment of the boot, whereby the snowboarder can alter the forward lean of the boot or can completely release the tension to facilitate walking in the boots when not riding on the snowboard. In FIG. 16, the engagement member 122 has been flipped up in the direction of arc 142, releasing the tension on the cable. Now, the snowboarder selects the desired amount of forward lean, by positioning the cable so it passes over a selected one of the dogs 128 or 130. Dog 128 provides a relatively lesser tension or less forward lean, while dog 130 provides an increased forward lean. After the desired amount of lean is selected, engagement member 122 is flipped back down in the direction of arc 144, which will put the cable in to tension, thereby tightening up the boot system to its desired degree of forward lean. FIG. 15 illustrates the cable passing over dog 130, in a more stiff configuration, while FIG. 13 shows the configuration with the cable passing over dog 128. FIG. 14 is a partial phantom side view of the engagement member in the configuration of FIG. 13, taken along line 14—14, illustrating the position of the cable relative to the dogs. It will be appreciated that more dogs can be provided, with different relative spacings, to enable further options to select for the boot forward lean. Enabling different degrees of lean allows the snowboarder to adjust the responsiveness of the boot binding system for riding style or conditions.

Figure 27:
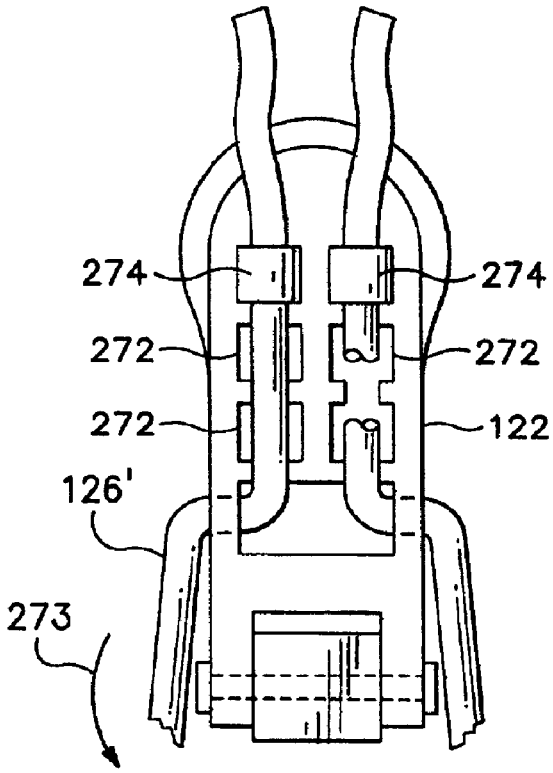
FIG. 27 is an alternative embodiment of the forward lean adjustment system of FIG. 13.

Referring to FIG. 27, an alternative engagement member 122' includes plural pairs of slots 272 in spaced relation to each other along the length of member 122'. Cable 126' is cut at the end to provide 2 separate ends thereto. Near each end of the cable, a cylindrical keeper 274 is fused thereto, where the keepers are sized so as to be received in any one of slots 272. A sufficient length of the cable extends beyond the keepers to allow grasping by the snowboarder. To adjust the amount of forward lean, the user flips up member 122' (to a configuration as in FIG. 16) and places the keepers of each side of the cable in a selected pair of slots 272, pushing the keepers down into the slots to be firmly engaged therein. Then, member 122' is flipped down in the direction of arrow 273, which puts the cable in tension and pulls the highback portion (upper shell) of the boot forwardly to the degree dictated by which set of slots 272 have the keepers therein. In the illustrated configuration, the keepers are positioned to provide the maximum amount of forward lean. To obtain the least amount of forward lean, the keepers would be moved to the slots 272 at the opposite end of member 122'. It will be understood by those of skill in the art that the boot can lean even further forward than the amount of lean dictated by the setting of the lean adjustment, but the lean adjustment defines a stop point of the rearward extent of the lean angle.

Figure 28:
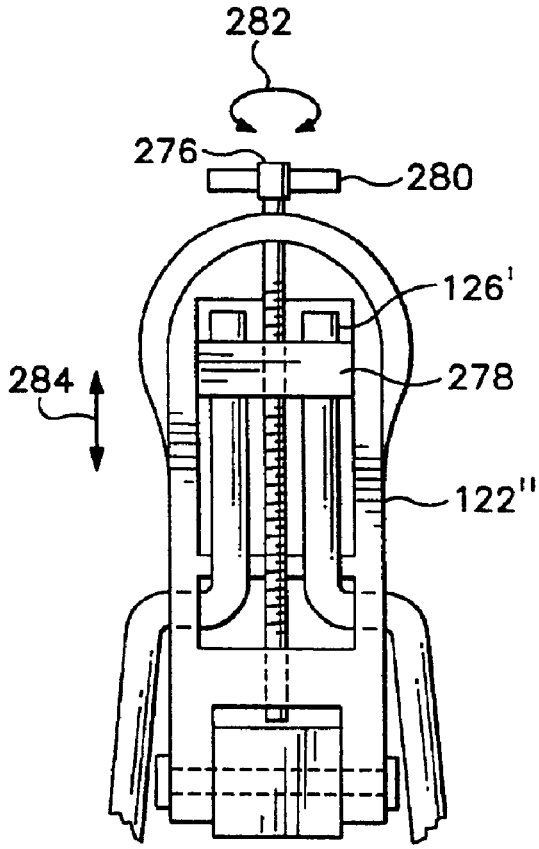
FIG. 28 is another embodiment of the forward lean adjustment system of FIG. 13.

FIG. 28 is another embodiment of a forward lean adjustment member 122". This embodiment carries a threaded shaft 276 that extends substantially the length of member 122". The two ends of cable 126' are secured to a stud 278 that is in threaded engagement with shaft 276. A handle 280 mounts to one end of the shaft to enable the shaft to be rotated (282) about its central axis. Stud 278 moves upwardly and downwardly along axis 284 as handle 280 is rotated, altering the position of the cable ends. Then, when member 122" is flipped down, the cable is put into tension with the desired amount of forward lean being provided.

Figure 35:
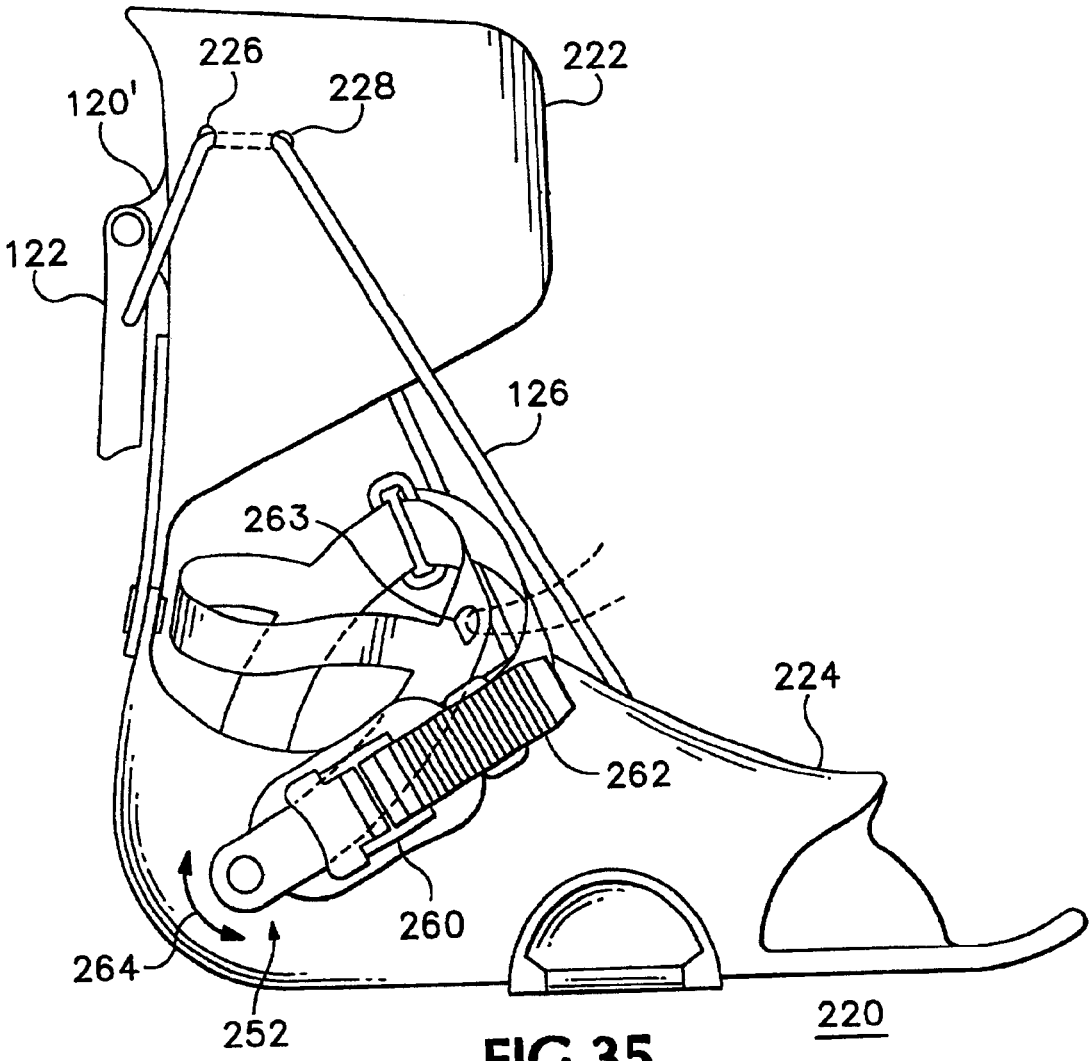
FIG. 35 is a lateral side view of interior elements of a snowboard boot illustrating the attachment of forward lean control aspects of the invention, with some external straps also shown.
Figure 36:
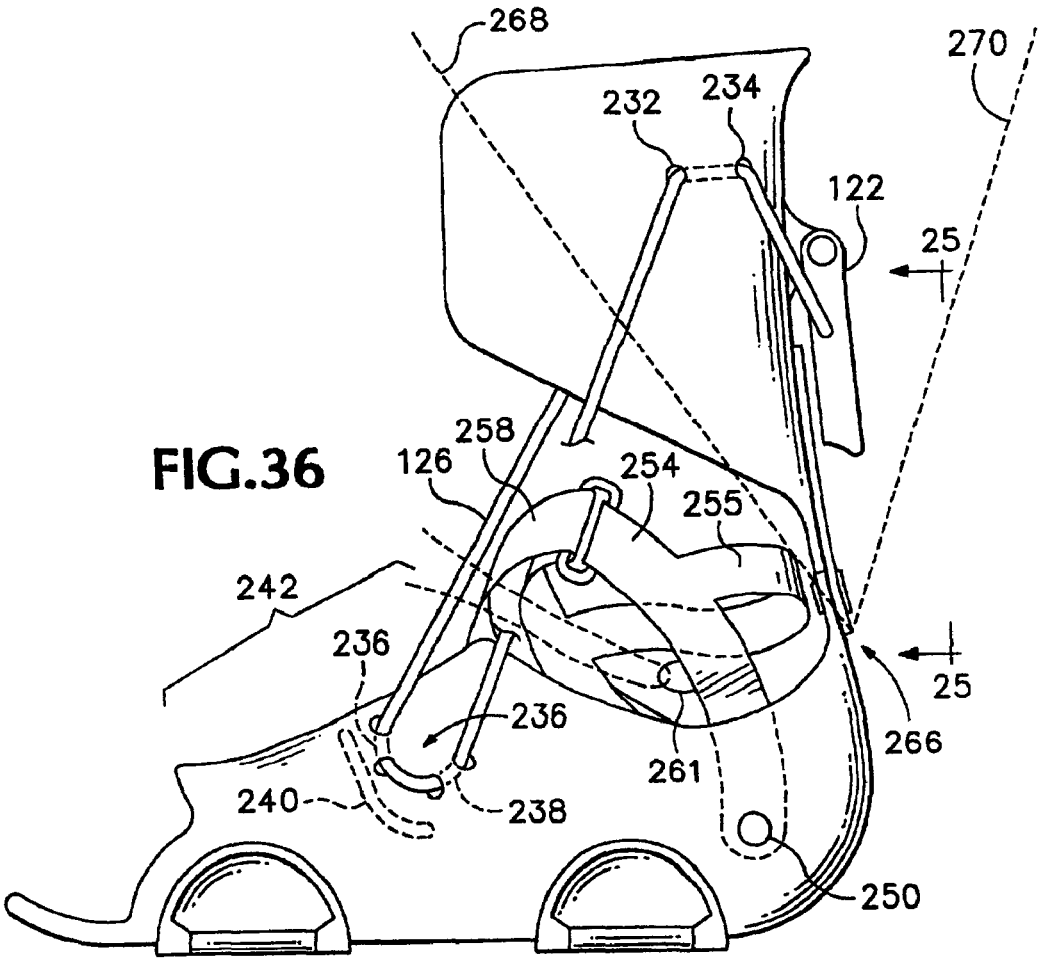
FIG. 36 is a medial side view of the interior boot elements and some external straps of FIG. 35.

Referring now to FIG. 35, which is a lateral side view of a preferred embodiment of some of the interior elements of a snowboard boot (in this case, the right boot) illustrating the attachment of forward lean control aspects of the invention, the boot includes a resilient inner shell 220, which in a preferred embodiment consists of an upper portion 222 that is adapted to partially encircle a user's lower calf, and a lower portion 224 that receives the foot therewithin. At the rear of the upper portion 222 is an attachment shaft or post 120'. In the illustrated embodiment, post 120' is positioned on the lateral side of a centerline of the boot, rather then being centered relative to the lateral and medial sides. The forward lean engagement member 122 attaches to the shaft (or post) 120' in a manner corresponding to that described herein in conjunction with FIGS. 13–15. Cable 126 passes through member 122 and then through a rearward aperture 226 in the upper shell portion 222 to the interior side of the shell. Continuing forwardly a short distance, suitably one-half inch, the cable then passes through a forward aperture 228, extending downwardly and crossing over the top of shell portion 224, to the other side of the boot. Referring now to FIG. 36, which is a view of the other side of the boot shell, the cable then passes through a loop back member 230 that redirects the cable direction to pass up toward the upper shell portion, passing through upper shell apertures 232 and 234, finally passing back down to the engagement member 122. In the illustrated embodiment, loop back member 230 comprises a first semicircular channel 236 and a second semicircular channel 238. These channels allow the cable to move while changing the direction of orientation thereof. The loop back is fixed in this particular embodiment, but in alternative embodiments, the loop back member can be moved forwardly or backwardly along the boot shell, to alter the attachment point there, and may comprise, for example, a pulley member that slides along and then fixedly engages a slot 240 (illustrated in phantom) in the shell. Slot 240 suitably can extend from the medial to the lateral side of the boot to allow a wide variation in the attachment position.

The bottom portion of the shell is suitably discontinuous over a central portion of the instep region 242, such that the top edges of the medial and lateral portions are separated from each other by approximately two inches. Also, the lower shell portion is open at the toe region. In use, the outer of the boot covers these components so that they are not visible to the user. It will also be observed that the binding engaging pins protrude from the lower shell portion and the voids 26, 36 and 38 are formed as a portion of the lower shell. Suitably, the lower shell is formed around the structural frame member, which carries the binding pins thereon.

Figure 25:
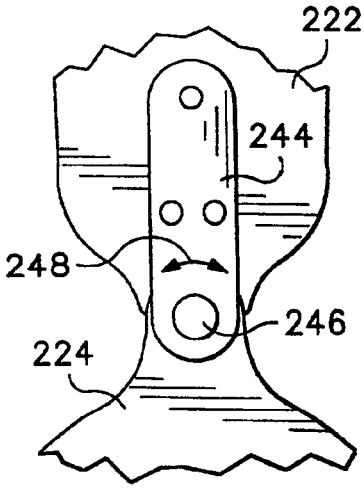
FIG. 25 is a partial rear view of the shell of FIG. 36 taken along line 25—25 of FIG. 36, illustrating the connection of the upper shell to the lower shell.

Referring to FIG. 25, a partial rear view of the shell of FIG. 36 taken along line 25—25 of FIG. 36, the upper and lower shell portions are suitably formed as discrete portions, and are secured to each other by an elongate and relatively stiff member 244, suitably an aluminum bar. The bar is attached to the upper portion by rivets, for example, and attaches to the lower portion via a hinge 246 that enables rotational motion of the two shells relative to each other along arc 248. Thus, the upper shell can flex medially and laterally with the user's calf, while the wearer is shifting about during snowboarding.

Figure 26:
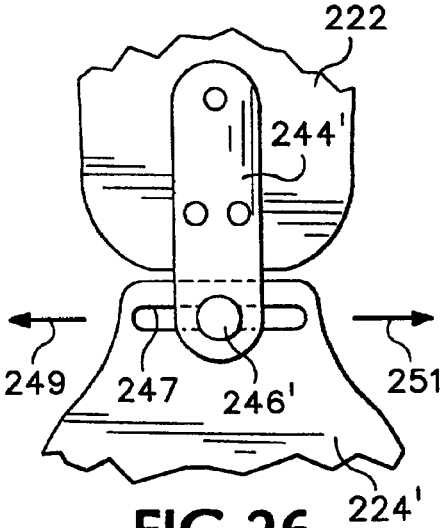
FIG. 26 is a partial rear view of an alternative embodiment of the connection of the upper and lower shells.

FIG. 26 is an alternative embodiment of the attachment of the upper and lower shells. In this embodiment, hinge 246' is received in a lateral slot 247 in member 224, whereby member 244 is adapted to move leftwardly or rightwardly along arrows 249 and 251 and to be fixed at a desired position, to allow adjustment of the flex point towards the lateral or medial side of the boot center line.

Also provided on the lower shell portion on both the medial and lateral sides are medial mounting aperture 250 and lateral mounting aperture 252. Medial aperture 250 mounts a strap 254 thereto, strap 254 extending out to a buckle 256 with which the strap is fixedly engaged. Strap 254 has a rear loop portion 255, adapted to go around the back side of a user's foot. Buckle 256 receives a second strap 258 therethrough, where a first end of strap 258 is secured to lateral aperture 252 on the interior of the shell. A second end of strap 258 attaches to a ratchet slide 260, which is engaged by ratchet strap 262. The ratchet strap is secured to the external of the shell at aperture 252 (and suitably externally of the boot outer in an assembled boot) and is free to rotate about the aperture along arc 264. These various straps cooperate to comfortably secure the user's foot to the boot. Further provided on the strap 254 on the medial and lateral sides of the boot are lace loops 261, 263, which enable the user to pass the boot laces therethrough, to provide further securement between the boot and the user.

Referring still to FIG. 36, the inner shell (and therefore the boot when completely assembled) can flex forwardly (illustrated by dash line 268) and rearwardly (illustrated by dash line 270) at the area indicated by arrow 266. Accordingly, as the user adjusts the amount of forward lean by altering the adjustment member 122, the boot will lean more or less forwardly, depending on the individual user's riding style. Further, when the adjustment member 122 is flipped upwardly to release the tension on cord 126, the boot can flex forwardly and backwardly as the user walks, for a more comfortable and less awkward stride when off of the snowboard.

An advantage over the prior art is provided by the present invention wherein the medial and lateral side cords 126 attach to the front or instep region of the shell at one general position. In accordance with the prior art, any forward lean adjusting straps connected to the respective side of the boot at which the strap originated. Therefore a medial side strap connected to the forward portion of the boot at the medial side and a lateral side strap connected to the forward portion of the boot at the lateral side. The invention's improved connection brings both the medial and lateral side cords to a single connection point or region on one side of the boot. In the illustrated embodiment, this side is the medial side. Therefore, the boot has improved flexing properties when riding.

The portion 224 of the boot shell is preferably split along the length of the foot receiving area, at an area above the top of the user's foot, to allow the shell to flex for tightening and untightening of the laces.

Figure 37:
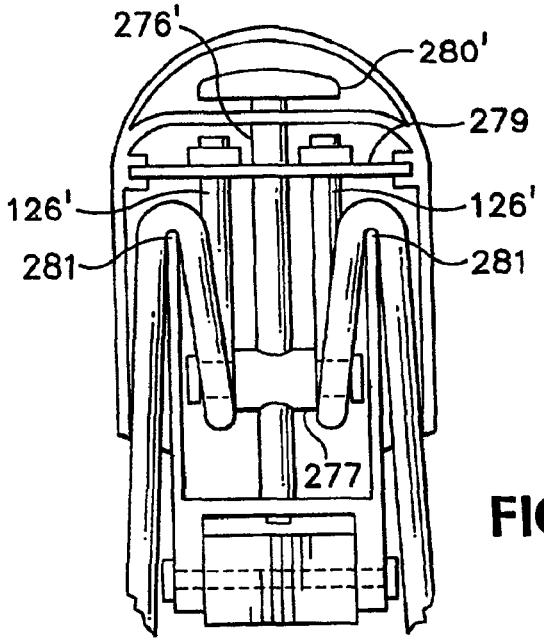
FIG. 37 is yet another alternative embodiment of the buckle for adjusting the forward lean of the boot.

FIG. 37 is a view of the components of yet another alternative engagement member. This member employs a rotatable threaded shaft 276', with a pulley 277 threadably mounted thereon. A knob 280' mounts to one end of shaft 276' to enable turning of the shaft. Cable ends 126' are fixed in position to a plate 279, and extend over the pulley and back up over guides 281, ultimately extending out of the body of the engagement member. In use, as knob 280' is turned, the pulley travels up and down the extent of the shaft, altering the effective length of the cables.

Figure 17:
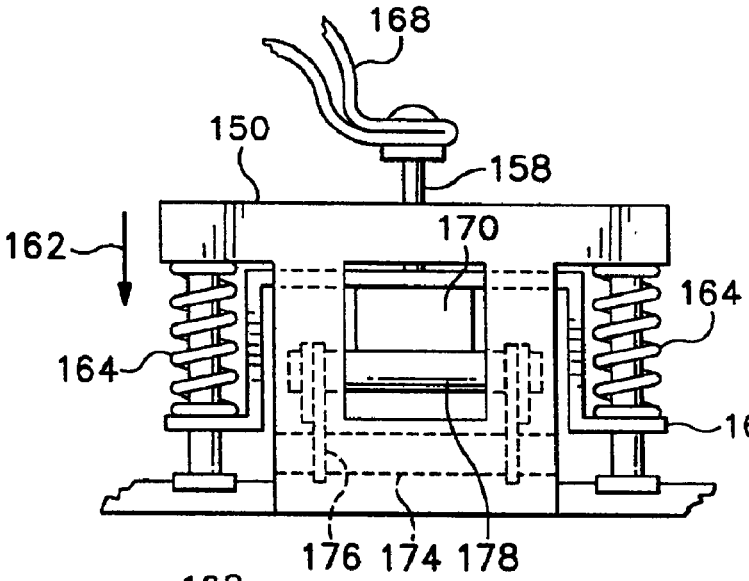
FIG. 17 is a medial side view of an alternative engaging system for a binding system according to the invention.
Figure 18:
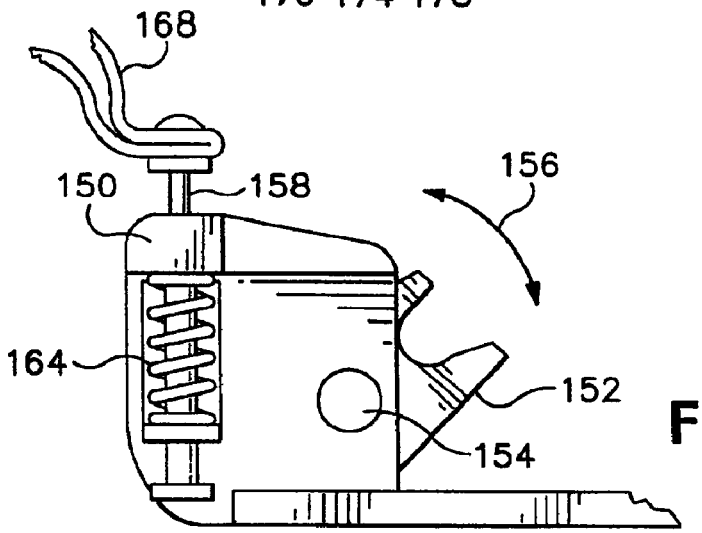
FIG. 18 is an end view of the engaging system of FIG. 17 with the engager in an open position.
Figure 19:
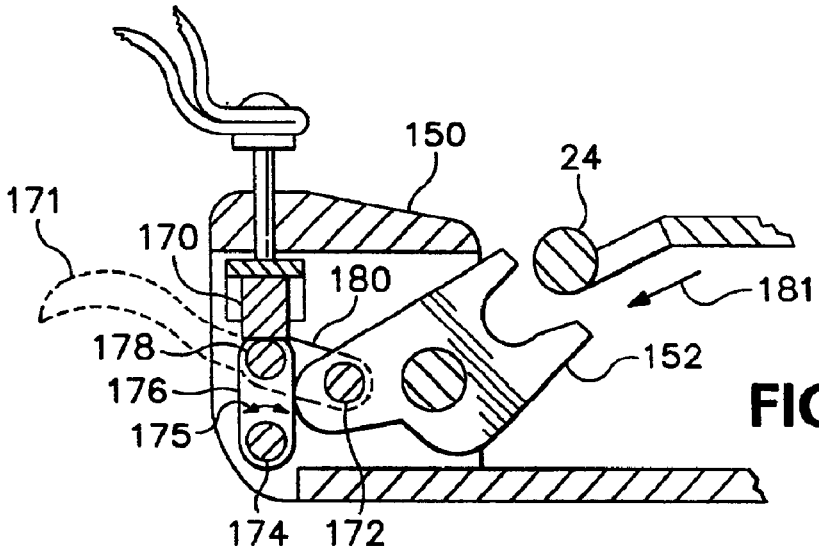
FIG. 19 is a sectional view of the mechanism of FIG. 18 just prior to engagement with the corresponding boot frame.
Figure 20:
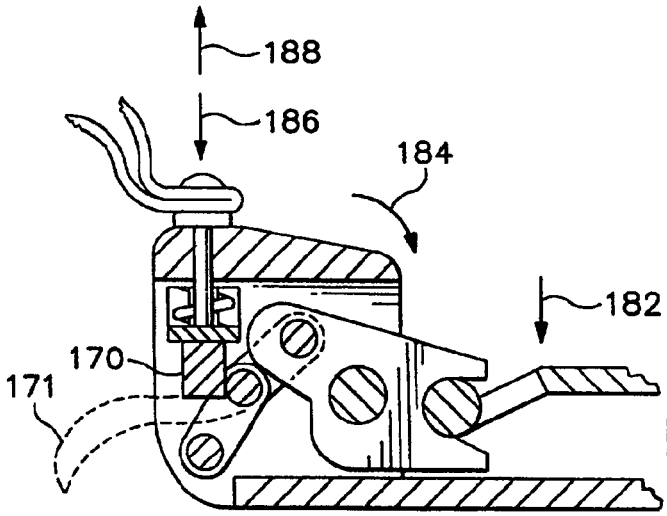
FIG. 20 is a sectional view of the mechanism of FIG. 18 after engagement and locking of the boot frame member.

An alternative embodiment of the step-in binding system is illustrated in FIGS. 17–20. Referring to FIG. 17 and FIG. 18, a medial side view and an end view respectively of an alternative engaging system for a binding system according to the invention, the apparatus for engaging the lateral binding pin 24 comprises a housing 150 which supports a binding pin receiver 152, pivotally mounted to a shaft 154 whereby the receiver 152 can pivot along the arc 156, from the open and ready to receive the pin position of FIG. 18, to the closed or locked position (FIG. 20). A release control shaft 158 mounts centrally of a bracket 160, which is biased downwardly in the direction of arrow 162 by a pair of springs 164. The springs are mounted on support shafts 166 that pass through an opening (not show) in left and right end flanges of the bracket 160. The lower ends of the springs rest against the flanges, while the upper ends press against an overhanging portion of the housing 150. Release control shaft has a release strap or cable 168 secured thereto, so a snowboarder can grasp the strap and pull to operate the release control. A wedge member 170 is carried by the central portion of bracket 160, and is oriented and extends downwardly. The center portion of the housing is substantially hollow, and provides a space in which the bracket can move upwardly and downwardly. Binding pin receiver 152 is removed from FIG. 17 to assist in viewing the internal components of the binding. Referring now to FIGS. 17 and 18, together with FIGS. 19 and 20, which are sectional views of the binding and housing interior, mounted within the housing are a second shaft 172 which is attached to a rear leg of the receiving member 152 and a third shaft 174, supported in fixed engagement with the housing. A first pair of connecting arms 176 are mounted on distal ends of and are pivotal about shaft 174 along arc 175, all within the interior of the housing. A fourth shaft 178 extends between the two arms 176, and also has a second pair of arms 180 mounted thereon at the distal ends of the shaft 178. Shaft 178 defines the "elbow" of the left and right compound arms defined by arms 176 and 180. Arms 180 also pivotally mount to shaft 172 on receiver 152.

In operation, as shown in FIGS. 19 and 20, as the snowboarder moves the boot in the direction of arrow 181 to bring the binding pin 24 into engagement with receiver 152, arm 176 is oriented substantially vertically, and is maintained in that position by the springs 164 exerting downward bias to cause the wedge 170 to press against the top of arm 176 and shaft 178. As the boot and binding pin move are moved down (arrow 182), receiver 152 will pivot along arc 184, pulling arm 180 forwardly, which also pulls pin 178 and arm 176 forwardly. Wedge 170 can move only downwardly at this point, and will travel down in the direction of arrow 186 as a result of the bias from the springs 164, moving the wedge behind pin 178. Since the wedge is now behind pin 178, receiver 152 is locked in place, since it cannot pivot, up, as it is interconnected via the shafts and arms to pin 178. The wedge essentially blocks the pin which prevents backward movement thereof and thereby prevents upward pivoting of the receiver. The binding pin 24 is therefore secured against movement, locking the boot to the binding. To release the binding, the snowboarder pulls upwardly on control strap 168 with sufficient force to overcome the bias of the springs 164, which moves the bracket 160 and wedge 170 up away from pin 172. Pin 172 then no longer blocked from rearward movement, so receiver 152 can now pivot upwardly and the snowboarder is able to step out of the binding. Illustrated in phantom in FIG. 19 and FIG. 20 is an alternative handle member 171 that is up when the binding is disengaged, and down when the binding is engaged.

Figure 21:
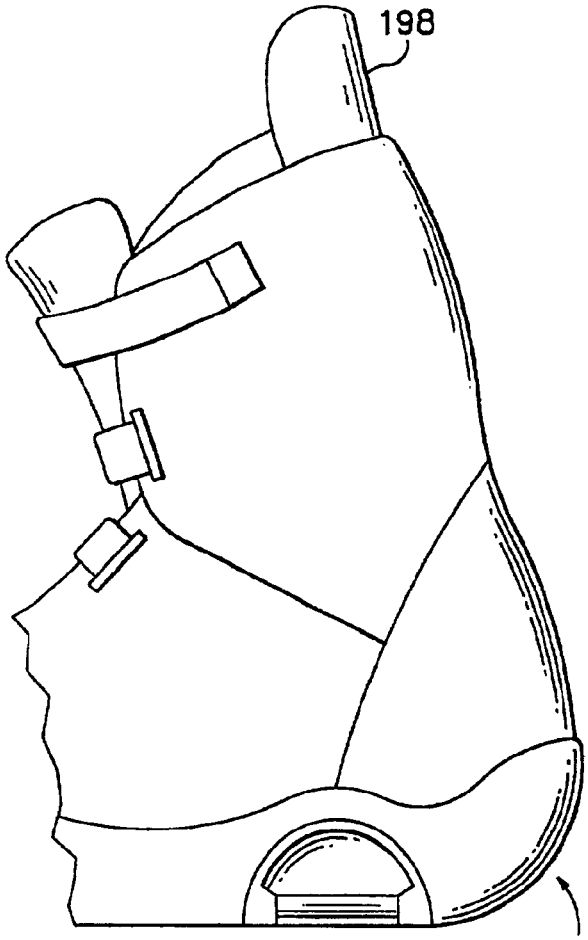
FIG. 21 is a side view of an embodiment of a snowboard boot illustrating adjustability aspects of the highback.
Figure 22:
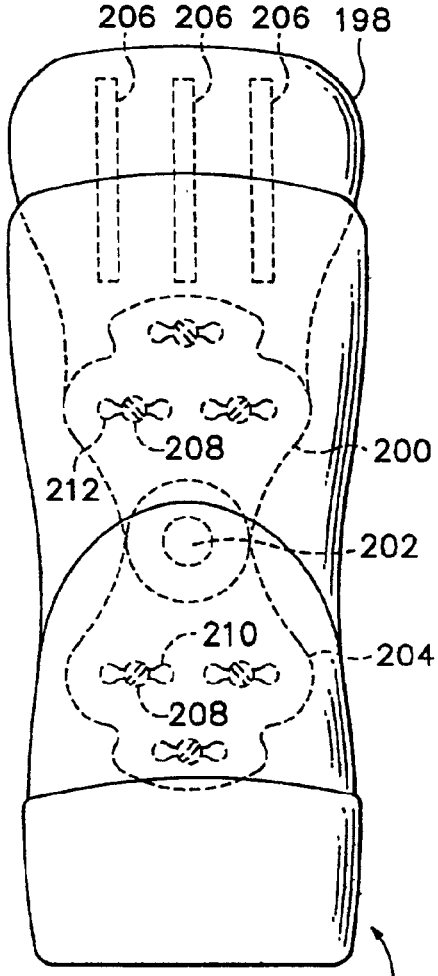
FIG. 22 is a partially phantom rear view of the boot of FIG. 21.

Referring now to FIG. 21 and FIG. 22, an additional aspect of a boot in accordance with the present invention comprises a calf plate 198 is positioned at the rear of the boot and may carry a series of vertically oriented stiffening ribs 206 thereon. The upper end of the plate extends out of the boot, while the lower end is fastened to the top plate 200 of the boot's internal highback. Top highback plate 200 is pivotal about hinge 202 relative to the lower highback plate 204 to allow flexing of the boot, and suitably is secured within the boot. Fasteners 208 received within slots 210 enable the highback to be loosened and shifted either more to the lateral side of the boot or more to the medial side. In a corresponding manner, calf plate 198 is secured by fasteners 208 in slots 212, and may also be shifted medially or laterally of the boot's center line by loosening the fasteners, sliding the calf plate to a new position, and retightening the fasteners. Therefore, the rider can move the highback so it is in a position and flexes in a manner preferred by that rider.

Figure 29:
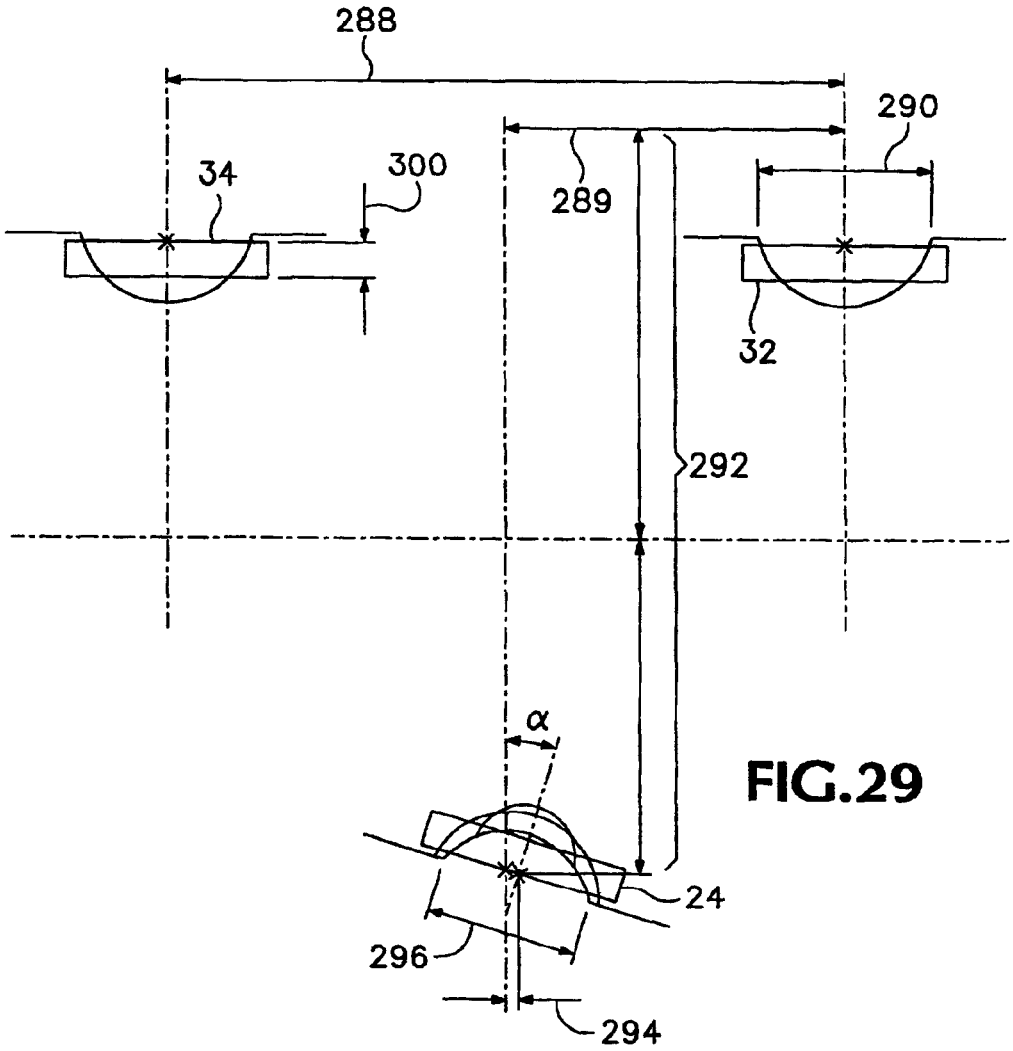
FIG. 29 is a top diagrammatic view of the spacing of the binding pins in accordance with the invention.

Referring to FIG. 29, a schematic diagram of the position of the medial and lateral binding pins, two preferred spacings thereof will be described. For a first size boot and binding, forward medial binding pin 32 and rearward medial binding pin 34 have their centers spaced at 4.620 inches from each other (distance 288). Distance 289 in the illustration is 2.310 inches, half of distance 288. Each medial binding pin suitably has 1.190 inches of pin exposed (distance 290) to the exterior when formed in a boot. Lateral binding pin 24 has its outer center positioned 4.242 inches from a line tangent to the outer edges of pins 32 and 34 (distance 292), the center of pin 24 being 0.101 inches forward of the center line between the medial pins (distance 294). Rather than being parallel to the medial pins, lateral binding pin 24 is tilted at an angle (17 degrees in the preferred embodiment) off the center line. Suitably, medial pin 24 has 1.045 inches of pin exposed at the outer edge when the boot is assembled (distance 296).

Figure 30:
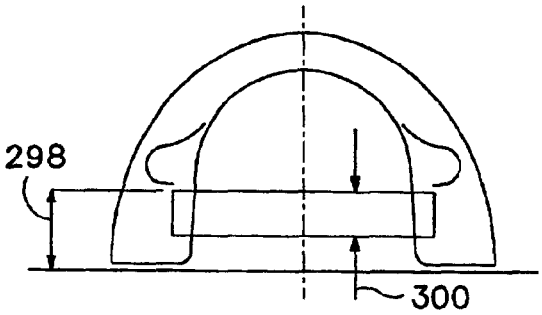
FIG. 30 is a side diagrammatic view of a single binding pin as installed in a boot.

Referring to FIG. 30, a side view of one binding pin as positioned within a boot, the top of the medial and lateral binding pins and the bottom of the boot are 0.436 inches apart (distance 298). The diameter of the pins is 0.250 inches (distance 300).

Figure 33:
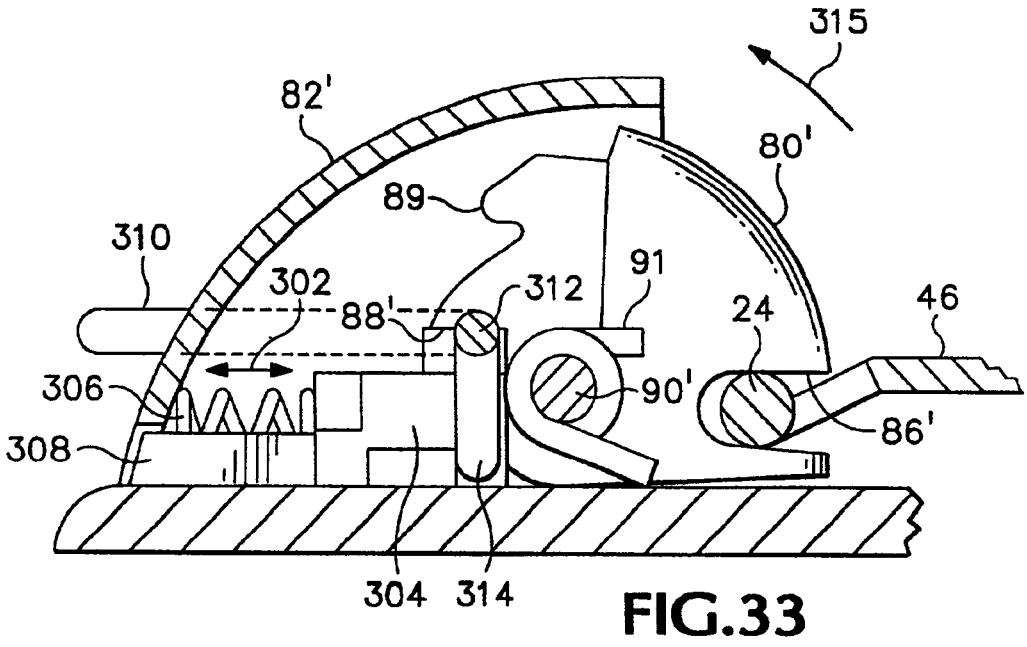
FIG. 33 is a sectional view of an engaged boot and binding with a preferred embodiment of the boot engaging mechanism.
Figure 34:
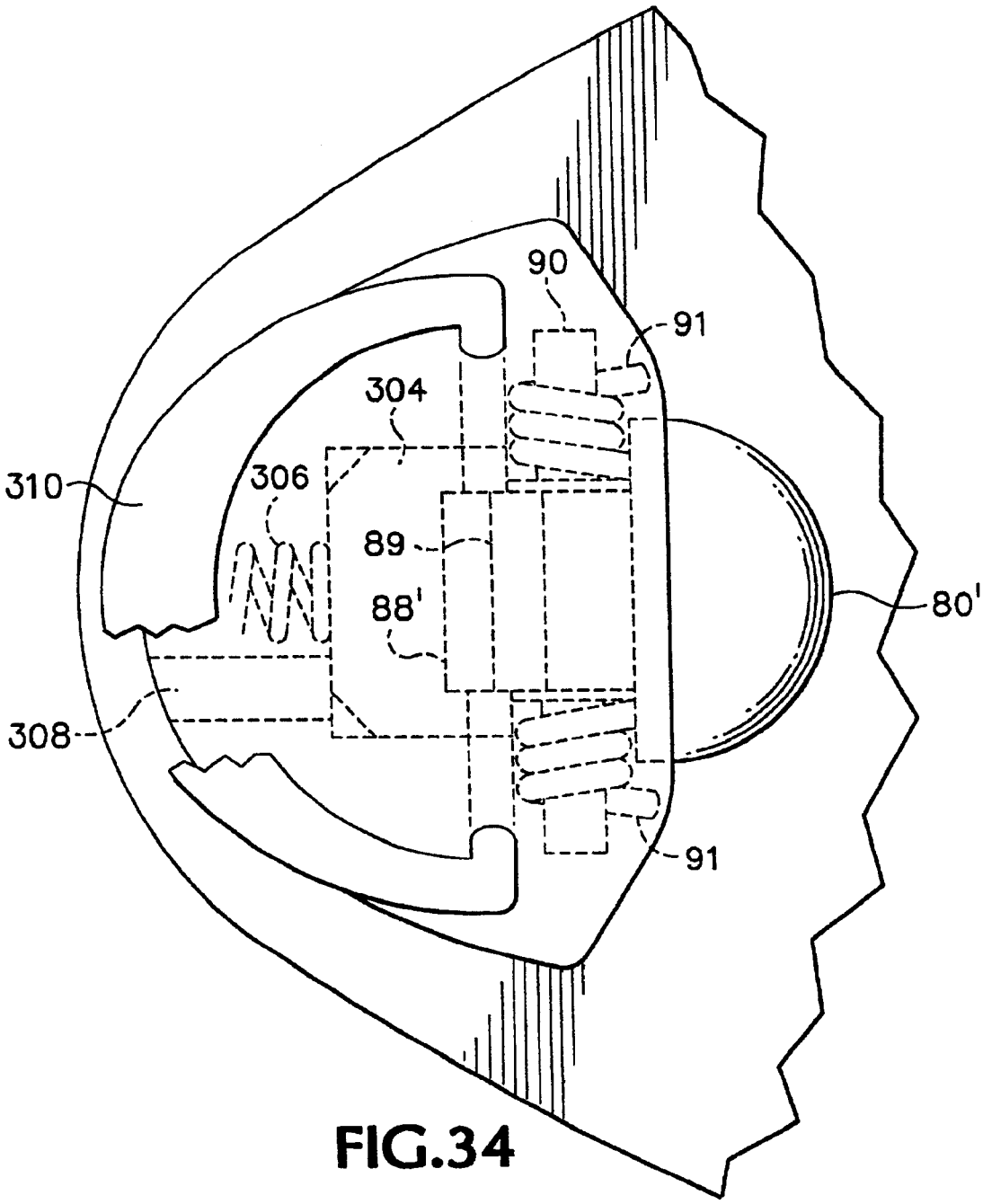
FIG. 34 is a top partially cut-away view of the binding system's boot engaging portion of FIGS. 32 and 33.

Referring to FIG. 33, a sectional view of a preferred embodiment of the boot engaging portion and FIG. 34, a top view thereof, a receiver 80' has a rearwardly extending arm portion 88' that is flat at the bottom surface thereof. An upper stop 89 is positioned at approximately 45 degrees between the horizontal and vertical planes. A laterally translatable catch 304 slides underneath the arm portion, to block rotation of the receiver 80' about its shaft 90'. Receiver 80 is urged to rotate in the direction of arc 315 by springs 91, positioned to either side of receiver 80' on shaft 90', but is prevented from doing so by the interaction of arm 88' and catch 304. Catch 304 is adapted to translate along axis 302, and is urged toward receiver 80' by biasing spring 306. A cover 82' is provided (shown in phantom). Catch 304 further includes a finger member 308 that extends away from rear portion of catch 304. The distal end of finger 308 stops at the edge of the cover 82'. An opening is provided in the cover to enable the finger to slide outwardly of the cover as the catch 304 moves away from the receiver along axis 302. An arm 310 is horizontally aligned and mounts to pivot axle 312, carrying a downwardly extending leg 314 that abuts against a front face of catch 304.

Figure 32:
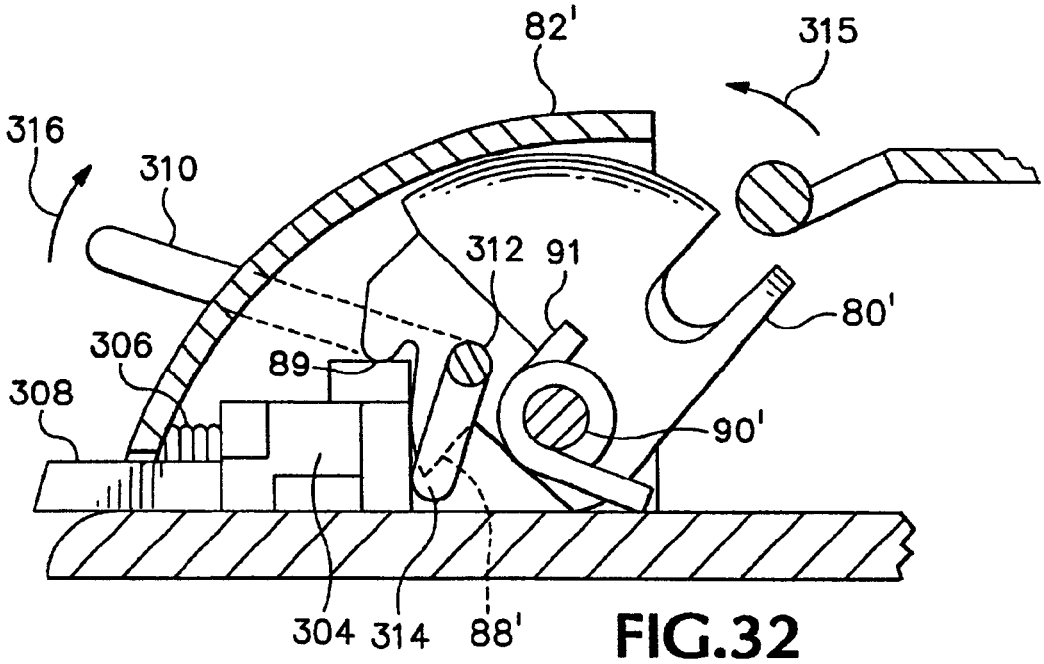
FIG. 32 is a sectional view of a preferred embodiment of the boot engaging portion of the binding system in a disengaged state.

Referring to FIG. 32, which illustrates the receiver in the open or released position, as arm 310 is moved upwardly in the direction of arrow 316, leg 314 pushes catch 304 rearwardly (against the bias of spring 306). Springs 91 cause the receiver to move up along arc 315, with the rearward limit of movement defined by the engagement of upper stop 89 and an upper portion of catch 304. Finger 308 extends outwardly of the cover 82', providing a visual indicator that the binding is disengaged. Arm 308 is preferably colored in a bright or contrasting color relative to the cover, to be highly visible when extended.

Therefore, in accordance with the invention, an improved binding system with a three point engagement is provided, enabling a more stable interaction between the boot and the binding. The binding is easily engaged, merely by stepping into it without requiring manual tightening of straps. Also, a boot with a releasable and adjustable tension system is provided. Further, the flexing characteristics of the boot may be individualized or varied to match different rider's skills or tastes, or to accommodate varying tastes of a single rider. The boot may also include a calf plate that extends above the rear of the boot, to provide additional adjustable support.

While a plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

The embodiments of the invention in which an exclusive property or privilege is claimed are defined as follows:

1. A boot, comprising:

a forward lean system, comprising:

medial and lateral side cable members on the boot, wherein the cable members are attached to the forward portion of the boot at only one general position thereon; and a tension adjustment member connected to the cable members for altering the length of said cable members, said length being the length between the tension adjustment member at the rear of the boot and the one general position at the forward portion of the boot to provide more or less forward lean of the boot relative to a vertical line.

2. A boot according to claim 1, wherein forward portions of said medial and lateral side cables attach to a forward portion of the boot on a location at a single side of the boot.

3. A boot according to claim 2, wherein said location is on a medial side of the boot.

4. A boot according to claim 1, wherein said tension adjustment member comprises an engaging arm pivotally attached to a rear portion of the boot.

5. A boot according to claim 4, wherein said arm includes plural engaging members for selective engagement of said cables to lengthen or shorten the effective length of the cables.

6. A boot according to claim 4, wherein said plural engaging members comprise slots and wherein said cables carry keeper members adapted to fit in one of said slots.

7. A boot according to claim 4, wherein said tension arm comprises an adjustable threaded member connected to said cables, wherein adjustment of said threaded member alters the effective length of said cables for alternating the forward lean of the boot.

8. A boot according to claim 7, wherein said adjustable threaded member is in threaded engagement with a pulley and adjustment of said threaded member alters the position of said pulley, said pulley receiving said cables thereon, thereby altering the effective length of said cables.

9. A boot, comprising:

a forward lean system, comprising:

medial and lateral side cable members on the boot, wherein said medial and lateral side cable members attach to a front portion of the boot at only one general position thereon, wherein said medial and lateral side cable members comprise portions of a continuous cable and wherein said cable loops back from the medial side to the lateral side of the boot around a loop back member at a front portion of the boot.

10. A boot according to claim 9, wherein said region comprises first and second locations that are within 2 inches of each other.

11. A boot according to claim 9, wherein said region comprises first and second locations that are within 1 inch of each other.

12. A boot according to claim 9, wherein said portion comprises first and second locations to which the medial and lateral side cable members attach, wherein said locations are substantially adjacent each other.

13. A boot according to claim 9, wherein said portion comprises a substantially single position.

14. A boot according to claim 13, wherein said single position comprises a pulley member attached to a front portion of the boot.

15. A boot according to claim 14, further comprising means for adjusting the relative position of said pulley member on the front portion of the boot.

16. A boot according to claim 9, further comprising means for altering the location of said single position on the front of said boot.

17. A boot according to claim 9, further comprising a calf plate pivotally attached to the highback portion.

18. A boot according to claim 17, wherein the calf plate includes reinforcing ribs.

19. A boot according to claim 17, wherein the highback portion includes a first and second member pivotally connected to each other.

20. A boot according to claim 17, wherein the highback portion is laterally and medially adjustable.

21. A boot according to claim 20, wherein the highback portion includes fasteners received within slots to allow lateral and medial movement.

22. A boot, comprising:

a forward lean system having a single general area on the boot, wherein the area is attached to forward portions of medial and lateral cable portions coming from respective rear upper opposite sides of the boot, said single general area located at a lower front location on the boot.

23. The boot of claim 22, wherein the single general area is located at either the lateral or medial side of the boot.

24. A snowboard boot, comprising:

a forward lean system, comprising:

a first guide located on a side of the boot on an upper, rear portion of the boot;

a second guide located on the same side as the first guide on a lower, front portion of the boot;

a third guide located on the side opposite of the first guide on an upper, rear portion of the boot;

a first cable portion extending from the first guide to the second guide; and a second cable portion extending from the second guide to the third guide.

25. A step-in snowboard boot, comprising:

a forward lean system, comprising:

a first guide located on a side of the boot on an upper, rear portion of the boot;

a second guide located on the same side as the first guide on a lower, front portion of the boot;

a third guide located on the side opposite of the first guide on an upper, rear portion of the boot; and a cable portion that extends from the first guide to the second guide and extends from the second guide to the third guide.

26. A step-in snowboard boot, comprising:

a forward lean system, comprising:

a tension adjustment member at the rear of the boot;

a first guide located on a side of the boot on an upper, rear portion of the boot;

a second guide located on the same side as the first guide on a lower, front portion of the boot;

a third guide located on the side opposite of the first guide on an upper, rear portion of the boot; and a cable portion that extends from the tension adjustment member to the first guide, the cable extends from the first guide to the second guide, and extends across the front of the boot from the second guide to the third guide, the cable portion extends from the third guide to the tension adjustment member.

* * * * *

UNITED STATES PATENT AND TRADEMARK OFFICE

CERTIFICATE OF CORRECTION

PATENT NO. : 6,883,255 B2
DATED : April 26, 2005
INVENTOR(S) : N.E. Morrow et al.

It is certified that error appears in the above-identified patent and that said Letters Patent is hereby corrected as shown below:

Title page,
Item [74], *Attorney, Agent, or Firm*, "Christen" should read -- Christensen --.

Column 15,
Line 33, "alternating" should read -- altering --.

Signed and Sealed this

Thirteenth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,883,255 B2
APPLICATION NO. : 09/761340
DATED : April 26, 2005
INVENTOR(S) : N.E. Morrow et al.

It is certified that error appears in the above-identified patent and that said Letters Patent is hereby corrected as shown below:

On the title page insert item --(73) Assignee: K-2 Corporation, Vashon, WA (US)--

Signed and Sealed this

Fifteenth Day of May, 2007

JON W. DUDAS
*Director of the United States Patent and Trademark Office*